US008903633B2

(12) United States Patent
Sasaki et al.

(10) Patent No.: US 8,903,633 B2
(45) Date of Patent: Dec. 2, 2014

(54) CONTROL SYSTEM FOR INTERNAL COMBUSTION ENGINE

(71) Applicant: Honda Motor Co., Ltd., Tokyo (JP)

(72) Inventors: Shizuo Sasaki, San Antonio, TX (US); Jayant Sarlashkar, San Antonio, TX (US); Gary D. Neely, San Antonio, TX (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/730,250

(22) Filed: Dec. 28, 2012

(65) Prior Publication Data

US 2013/0186380 A1 Jul. 25, 2013

Related U.S. Application Data

(62) Division of application No. 11/878,983, filed on Jul. 30, 2007.

(30) Foreign Application Priority Data

Aug. 18, 2006 (JP) ..... 2006-222841
Aug. 18, 2006 (JP) ..... 2006-222842
Aug. 18, 2006 (JP) ..... 2006-222843

(51) Int. Cl.
*F02D 41/00* (2006.01)
*F02D 35/02* (2006.01)
*F02D 41/30* (2006.01)

(52) U.S. Cl.
CPC ..... *F02D 41/30* (2013.01); *F02D 35/026* (2013.01); *F02D 41/3035* (2013.01)
USPC ..... 701/109; 701/101; 701/103; 701/104; 701/105; 701/108

(58) Field of Classification Search
USPC ..... 123/435, 436, 443, 480; 700/124; 701/101–103, 111, 115
See application file for complete search history.

(56) References Cited

U.S. PATENT DOCUMENTS

| | | | |
|---|---|---|---|
| 6,041,591 | A | 3/2000 | Kaneko et al. |
| 6,286,482 | B1 | 9/2001 | Flynn et al. |
| 2003/0066508 | A1 | 4/2003 | Nakayama et al. |
| 2003/0164166 | A1 * | 9/2003 | Takeuchi et al. ..... 123/674 |
| 2005/0065706 | A1 | 3/2005 | Gray, Jr. |

FOREIGN PATENT DOCUMENTS

| | | | |
|---|---|---|---|
| DE | 100 32 232 | A1 | 2/2001 |
| EP | 1 400 671 | A2 | 3/2004 |
| EP | 1 400 671 | A3 | 12/2006 |
| GB | 2 091 000 | A | 7/1982 |

(Continued)

*Primary Examiner* — Paul Hyun
*Assistant Examiner* — Robert Eom
(74) *Attorney, Agent, or Firm* — Mori & Ward, LLP

(57) ABSTRACT

A control system for an internal combustion engine, wherein in the control system, an in-cylinder oxygen amount is calculated and a compression end temperature, which is a temperature of the pressurized air-fuel mixture, is calculated according to an intake air temperature. A fuel injection parameter is determined according to the compression end temperature, the in-cylinder oxygen amount, and an engine rotational speed. The fuel injector is controlled based on the determined fuel injection parameter. By determining the fuel injection parameter according to the compression end temperature in addition to the in-cylinder oxygen amount, the combustion state is adjusted when the compression end temperature is low, thereby maintaining a stable combustion state.

19 Claims, 19 Drawing Sheets

(56) References Cited

FOREIGN PATENT DOCUMENTS

| | | | |
|---|---|---|---|
| JM | 2003-269204 | A | 9/2003 |
| JP | 07-279718 | A | 10/1995 |
| JP | 10-280978 | A | 10/1998 |
| JP | 11-093738 | A | 4/1999 |
| JP | 2002-106404 | A | 4/2002 |
| JP | 2002-188487 | A | 7/2002 |
| JP | 2002-327643 | A | 11/2002 |
| JP | 2003-027997 | A | 1/2003 |
| JP | 2003-176741 | A | 3/2003 |
| JP | 2003-286880 | A | 10/2003 |
| JP | 2004-011625 | A | 1/2004 |
| JP | 2004-060551 | A | 2/2004 |
| JP | 2006-207409 | A | 8/2006 |
| WO | WO 2005/090768 | A | 9/2005 |
| WO | WO 2006/050383 | A2 | 5/2006 |

* cited by examiner

CONTROL SYSTEM FOR INTERNAL COMBUSTION ENGINE

CROSS-REFERENCED TO RELATED APPLICATIONS

This is a Divisional application of U.S. patent application Ser. No. 11/878,983, filed Jul. 30, 2007, which claims priority to Japanese Patent Application Nos. 2006-222841, 2006-222842 and 2006-222843 filed Aug. 18, 2006, the disclosure of the prior applications are incorporated in their entirety by reference.

BACKGROUND OF THE INVENTION

1. Field of the Invention

The present invention relates to a control system for an internal combustion engine having an exhaust gas recirculation device that recirculates exhaust gases to an intake system, and particularly to a control system that estimates an amount of oxygen in a cylinder of the engine and performs fuel injection control according to the estimated amount of oxygen.

2. Description of the Related Art

Japanese Patent Laid-open No. 2006-29171 (JP '171) discloses a conventional control system which estimates an amount of oxygen contained in the air-fuel mixture in the cylinder before combustion (in-cylinder oxygen amount) based on a detected intake air amount and an estimated amount of recirculated exhaust gases. The control system then determines a fuel injection control parameter for a fuel injector according to the estimated in-cylinder oxygen amount.

According to the control system disclosed in JP '171, the control can be based on a gas temperature TI (hereinafter referred to as "intake air temperature") in an intake pipe. However, what affects the actual combustion characteristic of the air-fuel mixture in the cylinder is a temperature of the air-fuel mixture compressed in the cylinder. Accordingly, by only taking the intake air temperature TI into consideration, it is rather difficult to constantly maintain a stable combustion state, particularly in a so-called low temperature combustion mode or a premix combustion mode of a diesel engine.

Further, according to the above-described conventional control system, good performance cannot be obtained in the transient state of the engine. Therefore, there is a problem that the combustion noise becomes particularly large immediately after the end of the fuel cut operation, at which point, the oxygen concentration in the recirculated exhaust gases becomes relatively high.

Further, there is a problem that a torque shock occurs when shifting from an idling condition to a normal operating condition (e.g., a condition where a constant torque is generated at the rotational speed of about 2000 rpm), or vice versa, i.e., when the normal operating condition shifts to the idling condition.

Further, during the above-described transient state, the in-cylinder oxygen amount tends to be insufficient, and the combustion state may sometimes become unstable.

Further in the conventional control system disclosed in JP '171, it is necessary to increase a boost pressure in order to increase the in-cylinder oxygen amount in a high load operating condition wherein the accelerator pedal is greatly depressed, the exhaust gas recirculation is stopped, and the throttle valve is fully opened. However, since the boost pressure is in the vicinity of the maximum boost pressure, the rate of increase in the boost pressure is relatively low. Consequently, there is a problem that the in-cylinder oxygen amount becomes insufficient for the demand output, and the incremental amount of fuel is also insufficient, resulting in bad accelerating performance of the engine.

SUMMARY OF THE INVENTION

The present invention was attained contemplating the above-described points. A first aspect of the present invention is to provide a control system for an internal combustion engine which performs appropriate fuel injection control based on an amount of oxygen in the cylinder, thereby constantly maintaining a stable combustion state.

A second aspect of the present invention is to provide a control system for an internal combustion engine which suppresses combustion noise in the transient operating condition of the engine.

A third aspect of the present invention is to provide a control system for an internal combustion engine which prevents torque shock upon transition from the idling condition to the normal operating condition or vice versa and which makes the combustion state more stable.

A fourth aspect of the present invention is to provide a control system for an internal combustion engine which performs control in the high load operating condition of the engine, thereby improving the acceleration performance of the engine.

To attain at least the above-described four aspects, the present invention provides a control system for an internal combustion engine having an intake air amount controller for controlling an amount of air supplied to at least one cylinder through an intake system, at least one injector for injecting fuel into at least one cylinder, and an exhaust gas recirculation device for recirculating at least a portion of the exhaust gases to the intake system. The control system further includes an intake air amount detector, a rotational speed detector, an intake air temperature detector, a recirculated exhaust amount calculator, an in-cylinder oxygen amount calculator, a compression end temperature calculator, a fuel injection parameter determiner, and an injector controller. The intake air amount detector detects the intake air amount (GA) and the rotational speed detector detects a rotational speed (NE) of the engine. The intake air temperature detector detects an intake air temperature (TI) of the engine. The recirculated exhaust amount calculator calculates an amount (GE) of exhaust gases recirculated by the exhaust gas recirculation device. The in-cylinder oxygen amount calculator calculates an amount (O2) of oxygen existing in the cylinder based on the detected intake air amount (GA) and the calculated amount (GE) of recirculated exhaust gases. The compression end temperature calculator calculates a compression end temperature (TCMP) according to the intake air temperature (TI). The compression end temperature (TCMP) is a temperature in the cylinder when a piston in the cylinder is located in the vicinity of top dead center and the air-fuel mixture in the cylinder is compressed. The fuel injection parameter determiner determines a fuel injection parameter (Q*) by retrieving a fuel injection parameter map according to the compression end temperature (TCMP), the in-cylinder oxygen amount (O2), and the engine rotational speed (NE). The injector controller controls at least one injector based on the determined fuel injection parameter (Q*).

With the above-described structural configuration, the in-cylinder oxygen amount is calculated and the compression end temperature, which is a temperature of the pressurized air-fuel mixture, is calculated according to the intake air temperature. The fuel injection parameter is determined according to the compression end temperature, the in-cylinder oxygen amount, and the engine rotational speed. The injector is controlled based on the determined fuel injection parameter. By determining the fuel injection parameter according to the compression end temperature in addition to the in-cylinder oxygen amount, the combustion state is significantly improved when the compression end temperature is low, thereby maintaining a stable combustion state.

Preferably, the control system further includes an oxygen concentration calculator and an injection timing corrector. The oxygen concentration calculator calculates a concentration (O2N) of oxygen in the cylinder. The injection timing corrector corrects a fuel injection timing (TMM) contained in the fuel injection parameter (Q*) according to the oxygen concentration (O2N). The injector controller controls the at least one injector based on the corrected fuel injection parameter (Q*).

With the above-described structural configuration, the concentration of oxygen in the cylinder is calculated and the fuel injection timing is corrected according to the calculated oxygen concentration. For example, when the oxygen concentration in the recirculated exhaust gases becomes high, such as immediately after the end of the fuel cut operation, the in-cylinder oxygen concentration rapidly increases and the combustion noise is likely to increase. By correcting the fuel injection timing in the retarding direction according to the oxygen concentration, the combustion noise is suppressed.

Preferably, the control system further includes a demand torque parameter detector and an air handling parameter calculator. The demand torque parameter detector detects a parameter (AP) indicative of a demand torque of the engine. The air handling parameter calculator calculates an air handling parameter (A*) containing control parameters of the intake air amount controller and the exhaust gas recirculation device according to the parameter (AP) indicative of the demand torque of the engine and the rotational speed (NE) of the engine. In a predetermined low load operating condition of the engine, the air handling parameter calculator fixes the air handling parameter (A*), and the fuel injection parameter determiner determines the fuel injection parameter (Q*) according to the parameter (AP) indicative of the demand torque of the engine and the engine rotational speed (NE).

With the above-described structural configuration, the air handling parameter containing the control parameters of the intake air amount controller and the exhaust gas recirculation device is calculated according to the parameter indicative of the demand torque of the engine and the engine rotational speed. In the predetermined low load operating condition of the engine, the air handling parameter is fixed and the fuel injection parameter is calculated according to the parameter indicative of the demand torque of the engine and the engine rotational speed. In the predetermined low load operating condition, it is necessary to maintain the in-cylinder oxygen amount at the same level (or make the in-cylinder oxygen amount increase a little) in order to achieve a stable combustion state. Therefore, if the fuel injection parameter is determined according to the in-cylinder oxygen amount, the fuel injection amount becomes excessive, thereby potentially inducing a torque shock. By fixing the air handling parameter, a sufficient in-cylinder oxygen amount is secured, and a stable combustion state is achieved. Further, by determining the fuel injection parameter according to the parameter indicative of the demand torque, a smooth control of the engine output torque is attained which prevents the torque shock from occurring.

Preferably, the fuel injection parameter determiner determines the fuel injection parameter (Q*) by retrieving a fuel injection parameter map according to a fuel control index (k) and the engine rotational speed (NE). The fuel control index (k) is calculated based on the in-cylinder oxygen amount (O2) in the normal operating condition and is calculated based on the parameter (AP) indicative of the demand torque in the predetermined low load operating condition.

With the above-described structural configuration, the fuel injection parameter is determined by retrieving the fuel injection parameter map according to the fuel control index and the engine rotational speed. The fuel control index is calculated based on the in-cylinder oxygen amount in the normal operating condition and is also calculated based on the parameter indicative of the demand torque in the predetermined low load operating condition. By using the fuel control index and changing the calculation method of the fuel control index according to the engine operating condition, the maps for determining the fuel injection parameter and the processes for retrieving the maps can be commonly used irrespective of engine operating conditions.

Preferably, when the parameter (AP) indicative of the demand torque increases in the predetermined low load operating condition, the fuel injection parameter calculator switches calculation of the fuel injection parameter (Q*) according to the parameter (AP) indicative of the demand torque to calculating the fuel injection parameter (Q*) according to the in-cylinder oxygen amount (O2) if the in-cylinder oxygen amount (O2) is greater than the minimum oxygen amount (O2C) to achieve a stable combustion state; the parameter (AP) indicative of the demand torque is greater than a determination threshold value (APTH); and the fuel injection amount calculated according to the parameter (AP) indicative of the demand torque coincides with the fuel injection amount suitable for the in-cylinder oxygen amount (O2).

With the above-described structural configuration, when the parameter indicative of the demand torque increases in the predetermined low load operating condition, calculation of the fuel injection parameter according to the parameter indicative of the demand torque is switched to calculating the fuel injection parameter according to the fuel control index if the in-cylinder oxygen amount is greater than the minimum oxygen amount for achieving the stable combustion state; the parameter indicative of the demand torque is greater than the determination threshold value; and the fuel injection amount calculated according to the parameter indicative of the demand torque coincides with the fuel injection amount suitable for the in-cylinder oxygen amount. According to the above-described manner of performing switching control, torque shock is prevented from occurring when the operating condition shifts from the predetermined low load operating condition to a higher load operating condition.

Preferably, the predetermined low load operating condition is an operating condition where an output torque of the engine is within a range from a negative value to a value slightly greater than "0" and the engine rotational speed (NE) is higher than an idling rotational speed.

With the above-described structural configuration, the predetermined low load operating condition corresponds to a transient operating condition where the accelerator pedal is depressed in the idling condition and the operation amount of the accelerator pedal increases or to a transient operating condition where the accelerator pedal is being returned from the normal partial-load operating condition. In such transient operating conditions, a stable combustion state is secured and torque shock is prevented from occurring.

Preferably, the control system includes an engine operating condition determiner for determining that the operating condition of the engine has shifted to the predetermined low load operating condition if the in-cylinder oxygen amount (O2) reaches the minimum oxygen amount (O2C) to achieve the stable combustion state when the parameter (AP) indicative of the demand torque decreases in the normal operating condition.

With the above-described structural configuration, when the parameter indicative of the demand torque decreases in the normal operating condition, it is determined that the operating condition of the engine has shifted to the predetermined low load operating condition if the in-cylinder oxygen amount reaches the minimum oxygen amount to achieve a stable combustion state. Therefore, when the in-cylinder oxygen amount reaches the minimum oxygen amount, the control suitable for the predetermined low load operating condition is started, and a required in-cylinder oxygen amount is secured to maintain a stable combustion state.

Preferably, the control system further includes a fuel injection amount corrector for correcting a fuel injection amount (QINJ) contained in the fuel injection parameter (Q*) in the increasing direction when the engine is in a predetermined high load operating condition. The fuel injector amount controller controls the at least one injector based on the corrected fuel injection parameter.

With the above-described structural configuration, the fuel injection amount contained in the fuel injection parameter is corrected in the increasing direction when the engine is in the predetermined high load operating condition. Thus, the accelerating performance of the engine is improved.

Preferably, the engine has a supercharging device for pressurizing an intake pressure, and the control system includes a boost pressure controller for controlling the supercharging device to increase a boost pressure when the engine is in the predetermined high load operating condition.

With the above-described structural configuration, in the predetermined high load operating condition, the supercharging device is controlled to increase the boost pressure. The in-cylinder oxygen amount is increased by controlling the supercharging device to increase the boost pressure, and the effect of increasing the in-cylinder oxygen amount is enhanced by increasing the fuel injection amount. Consequently, a sufficient amount of the in-cylinder oxygen is secured, and good accelerating performance is obtained.

Preferably, the predetermined high load operating condition is an operating condition where the parameter (AP) indicative of the demand torque is greater than a high load determination threshold value (APHLTH), and the exhaust gas recirculation performed by the exhaust gas recirculation device is stopped.

With the above-described structural configuration, good accelerating performance is obtained in the engine operating condition where the parameter indicative of the demand torque is greater than the predetermined threshold value and the exhaust gas recirculation performed by the exhaust gas recirculation device is stopped.

Preferably, the fuel correcting means sets a degree (RQAD) of increasing the fuel injection amount so that an amount of soot emitted from the engine becomes equal to or less than a predetermined limit value (QSTLMT).

With the above-described structural configuration, the degree of increasing the fuel injection amount is set so that the amount of soot emitted from the engine becomes equal to or less than the predetermined limit value. Therefore, good accelerating performance is obtained while suppressing an amount of soot generated in the engine.

Preferably, the fuel injection parameter determiner calculates a fuel control index (k) according to the in-cylinder oxygen amount (O2) and determines the fuel injection parameter (Q*) by retrieving a fuel injection parameter map according to the fuel control index (k) and the engine rotational speed (NE). The fuel injection amount corrector performs the correction by modifying the fuel control index (k).

With the above-described structural configuration, the fuel injection parameter is determined by retrieving the fuel injection parameter map according to the engine rotational speed, and the fuel control index is calculated according to the in-cylinder oxygen amount. Further, correction of the fuel injection amount in the increasing direction is performed by modifying the fuel control index. By using the fuel control index and modifying the fuel control index in the predetermined high load operating condition, the maps for determining the fuel injection parameter and the processes for retrieving the maps can commonly be used irrespective of the engine operating conditions.

DETAILED DESCRIPTION OF THE PREFERRED EMBODIMENTS

Preferred embodiments of the present invention will now be described with reference to the drawings.

Figure 1:
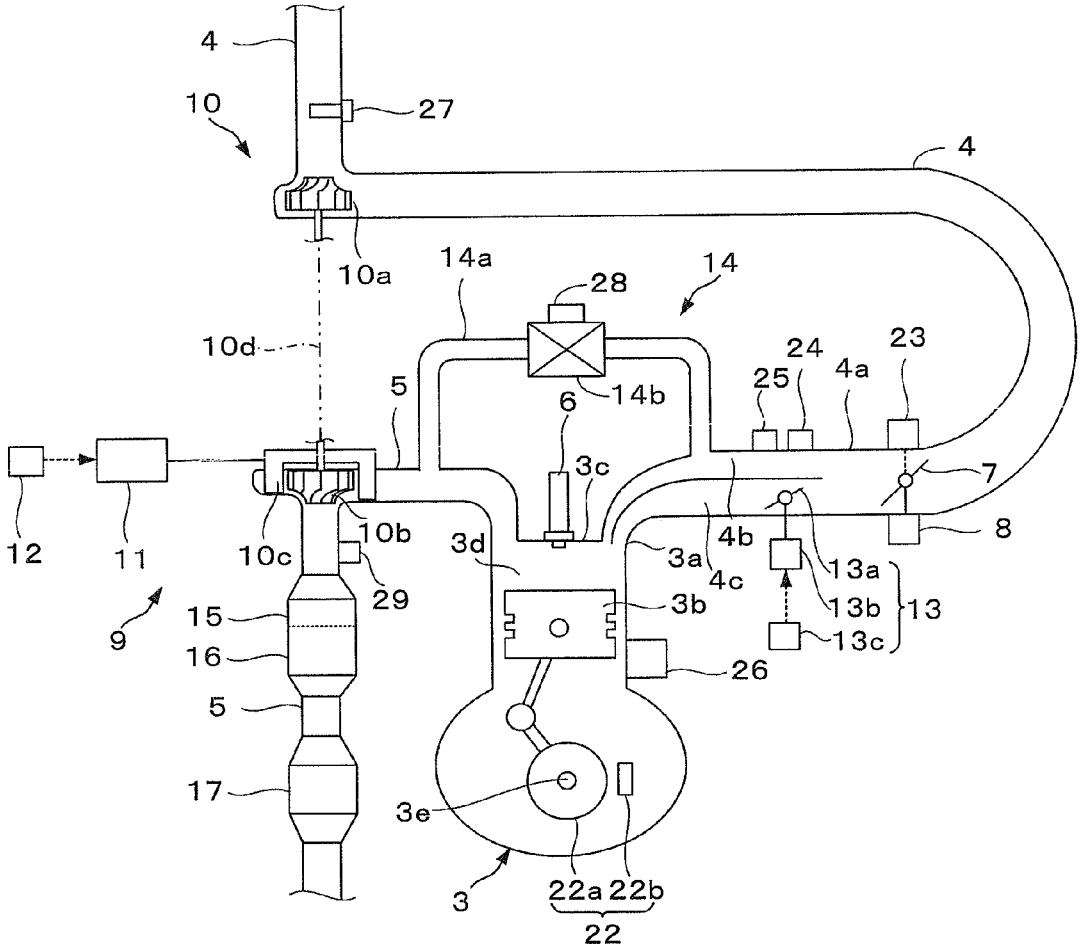
FIG. 1 is a schematic diagram of an internal combustion engine and peripheral devices therefor according to one embodiment of the present invention.

An internal combustion engine 3 (hereinafter referred to as "engine") shown in FIG. 1 is, for example, a four-cylinder (only one cylinder is illustrated) diesel engine mounted on a vehicle (not shown). A combustion chamber 3*d* is formed between a piston 3*b* and a cylinder head 3*c* of each cylinder 3*a*. An intake pipe 4 (intake system) and an exhaust pipe 5 are connected to the combustion chamber 3*d*, and an intake port and an exhaust port are respectively provided with an intake valve and an exhaust valve (neither valve is illustrated). Further, a fuel injection valve 6 (hereinafter referred to as "injector") is mounted in a cylinder head 3*c* and faces the combustion chamber 3*d*.

Figure 2:
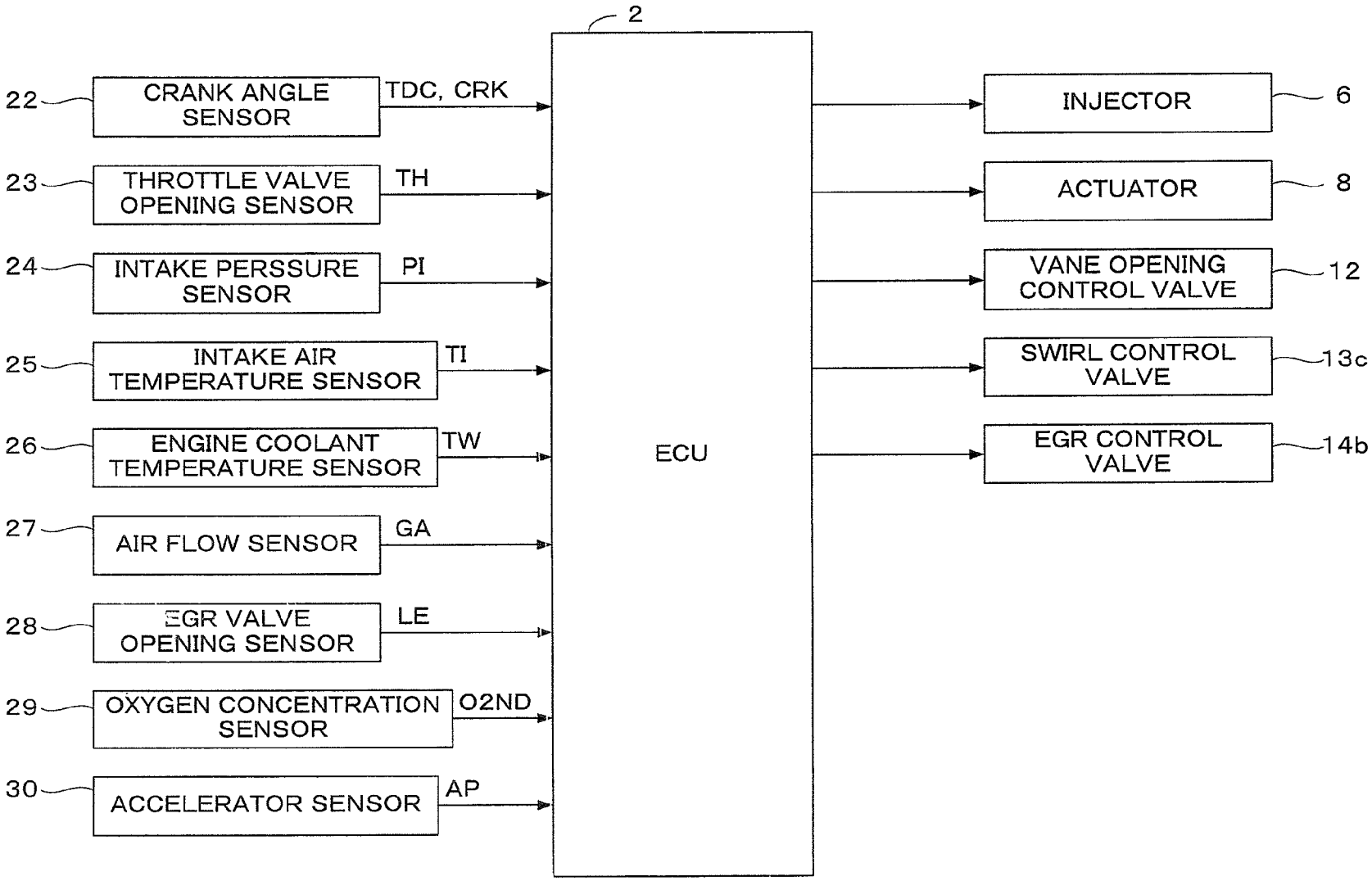
FIG. 2 is a block diagram of a control system for the internal combustion engine shown in FIG. 1.

The injector 6 is disposed in the center of the cylinder head 3*c* and is connected to a high-pressure pump through a common-rail (neither is illustrated). Fuel from a fuel tank (not shown) is pressurized by the high-pressure pump, supplied to the injector 6 through the common-rail and is injected from the injector 6 into the combustion chamber 3*d*. An injection pressure, an injection period (fuel injection amount), and an injection timing (valve opening timing) of the injector 6 are controlled by control signals from an electronic control unit 2 (hereinafter referred to as "ECU") shown in FIG. 2. FIG. 2 is also referred to in the following description.

A magnet rotor 22*a* is mounted on a crankshaft 3*e* of the engine 3. The magnet rotor 22*a* and an MRE pickup 22*b* define a crank angle sensor 22. The crank angle sensor 22 outputs a CRK signal and a TDC signal, which are pulse signals, to the ECU 2 when the crankshaft 3*e* rotates.

The CRK signal is output at every predetermined crank angle (e.g., 30 degrees). The ECU 2 detects a rotational speed NE (hereinafter referred to as "engine rotational speed") of the engine 3 based on the CRK signal. The TDC signal is a signal indicating that the piston 3*b* of each cylinder is at a predetermined crank angle position near the TDC (top dead center) corresponding to the start of an intake stroke of each cylinder. The TDC signal is output at every 180-degree crank angle in this embodiment of the four-cylinder engine.

A throttle valve 7 is provided upstream of a joined portion of an intake manifold 4*a* of the intake pipe 4, and an actuator 8 for actuating the throttle valve 7 is connected to the throttle valve 7. The actuator 8 includes a motor (not illustrated), a gear mechanism (not illustrated), and the like, and the operation of the actuator 8 is controlled by a control signal from the ECU 2. Accordingly, an opening TH of the throttle valve 7 (hereinafter referred to as "throttle valve opening") is changed by the control signal from the ECU 2, and an intake air amount supplied to the combustion chamber 3*d* is controlled. The throttle valve opening TH is detected by a throttle valve opening sensor 23, and the detection signal is output to the ECU 2.

The intake manifold 4*a* is provided with an intake pressure sensor 24 and an intake air temperature sensor 25. The intake pressure sensor 24 detects a pressure PI in the intake manifold 4*a* (hereinafter referred to as "intake pressure"). The intake air temperature sensor 25, such as a thermistor, detects a temperature TI in the intake manifold 4*a* (hereinafter referred to as "intake air temperature"). The detection signals are supplied to the ECU 2. An engine coolant temperature sensor 26 is mounted on the body of the engine 3. The engine coolant temperature sensor 26, such as a thermistor, detects a temperature TW of coolant circulating through the body of the engine 3 (hereinafter referred to as "engine coolant temperature"), and outputs the detection signal to the ECU 2.

Further, the intake pipe 4 is provided with a supercharging device 9. The supercharging device 9 includes a turbocharger 10, an actuator 11 connected with the supercharger, and a vane opening control valve 12. The turbocharger 10 has a compressor blade 10*a*, a turbine blade 10*b*, a plurality of movable vanes 10*c* (only two are illustrated), and a shaft 10*d*. The compressor blade 10*a* is provided upstream of the throttle valve 7 in the intake pipe 4. The turbine blade 10*b* is provided in the exhaust pipe 5. The movable vanes 10*c* are pivotably mounted on the shaft 10*d* which connects the blades 10*a* and 10*b* so as to rotate in one body. The turbocharger 10 performs a supercharging operation via the compressor blade 10*a* which rotates in one body with the turbine blade 10*b* that is rotationally driven by the exhaust gases in the exhaust pipe 5.

Each movable vane 10*c* is connected to an actuator 11, and an opening VO (hereinafter referred to as "vane opening") of the movable vane 10*c* is controlled through the actuator 11. The actuator 11 which includes a diaphragm being displaced by a negative pressure, is connected through a vane opening control valve 12 to a negative-pressure pump (not shown). The negative-pressure pump is driven by the engine 3 and supplies the generated negative pressure to the actuator 11. The vane opening control valve 12 is an electromagnetic valve whose opening is controlled by a control signal from the ECU 2. Accordingly, the negative pressure supplied to the actuator 11 changes according to the control signal, and the vane opening VO of the movable vane 10*c* changes to control the boost pressure.

An air flow sensor 27 is provided upstream of the turbocharger 10 in the intake pipe 4. The air flow sensor 27 detects a flow rate GA of intake air flowing in the intake pipe 4 and outputs a detection signal to the ECU 2.

The intake manifold 4*a* of the intake pipe 4 is divided into a swirl passage 4*b* and a bypass passage 4*c* from the joined portion. The bypass passage 4*c* is provided with a swirl device 13 for generating a swirl in the combustion chamber 3*d*. The swirl device 13 includes a swirl valve 13*a*, an actuator 13*b* for actuating the swirl valve 13*a*, and a swirl control valve 13*c*. The actuator 13*b* and the swirl control valve 13*c* are, respectively, configured like the actuator 11 of the supercharging device 9 and the vane opening control valve 12, and the swirl control valve 13*c* is connected to the negative-pressure pump. With the configuration described above, the valve opening of the swirl control valve 13*c* is controlled by the control signal from the ECU 2, thereby changing the negative pressure supplied to the actuator 13*b*. Accordingly, an opening SVO of the swirl valve 13*a* changes to control the strength of the swirl.

An exhaust gas recirculation pipe 14*a* (hereinafter referred to as "EGR pipe") is connected between the joined portion of the swirl passage 4*b* of the intake manifold 4*a* and the upstream side of the turbine blade 10*b* of the exhaust pipe 5. The EGR pipe 14*a* and an exhaust gas recirculation control valve 14*b* (hereinafter referred to as "EGR control valve") disposed in the EGR pipe 14*a* constitute an exhaust gas recirculation device 14 (hereinafter referred to as "EGR device"). A portion of the exhaust gases of the engine 3 is recirculated to the intake pipe 4 as recirculated exhaust gas through the EGR pipe 14*a*. The EGR control valve 14*b* is a linear electromagnetic valve, and a recirculated exhaust gas flow rate GE is controlled by changing an opening LE (hereinafter referred to as "EGR valve opening") of the EGR valve 14*b* according to the control signal from the ECU 2. The EGR valve opening LE is detected by an EGR valve opening sensor 28, and a detection signal is outputted to the ECU 2.

The exhaust pipe 5 downstream of the turbine blade 10*b* is provided with an oxidation catalyst 15, a DPF (diesel particulate filter) 16, and a NOx absorbent catalyst 17 in this order from the upstream side. The oxidation catalyst 15 oxidizes HC and CO in the exhaust gas to purify the exhaust gas. The DPF 16 traps soot contained in the exhaust gas. A DPF regeneration control is timely performed to raise an exhaust temperature in order to burn the soot trapped in the DPF 16. The NOx absorbent catalyst 17 absorbs NOx in the exhaust gas and in an oxidizing condition where an oxygen concentration is relatively high compared with a concentration of the reducing components (CO, HC) in the exhaust gas, and reduces the absorbed NOx in a reducing condition where the concentration of reducing components is relatively high compared with the oxygen concentration.

An oxygen concentration sensor 29 is provided between the turbine blade 10*b* and the oxidation catalyst 15 in the exhaust pipe 5. The oxygen concentration sensor 29 detects an oxygen concentration O2ND in the exhaust gas, and outputs a detection signal to the ECU 2. The ECU 2 calculates an air-fuel ratio NF of an air-fuel mixture formed in the combustion chamber 3*d* based on the oxygen concentration O2ND. Further, a detection signal indicative of an operation amount AP of the accelerator pecal (not shown) of the vehicle driven by the engine 3 (hereinafter referred to as "accelerator pedal operation amount AP") is output from an accelerator opening sensor 30 to the ECU 2.

The ECU 2 consists of a microcomputer including input and output interfaces, a CPU, a RAM, a ROM, and the like, and executes various calculation processes based on the control programs stored in the ROM according to the detection signals from the various sensors 22 to 30 described above. Specifically, the ECU 2 determines an operating condition of the engine 3 from the above-described detection signals and further determines a control mode for controlling combustion of the engine 3 based on the determination result. Further, the ECU 2 performs controls of the intake air amount, the recirculated exhaust gas amount, and the fuel injection, corresponding to the determined control mode.

Figure 3:
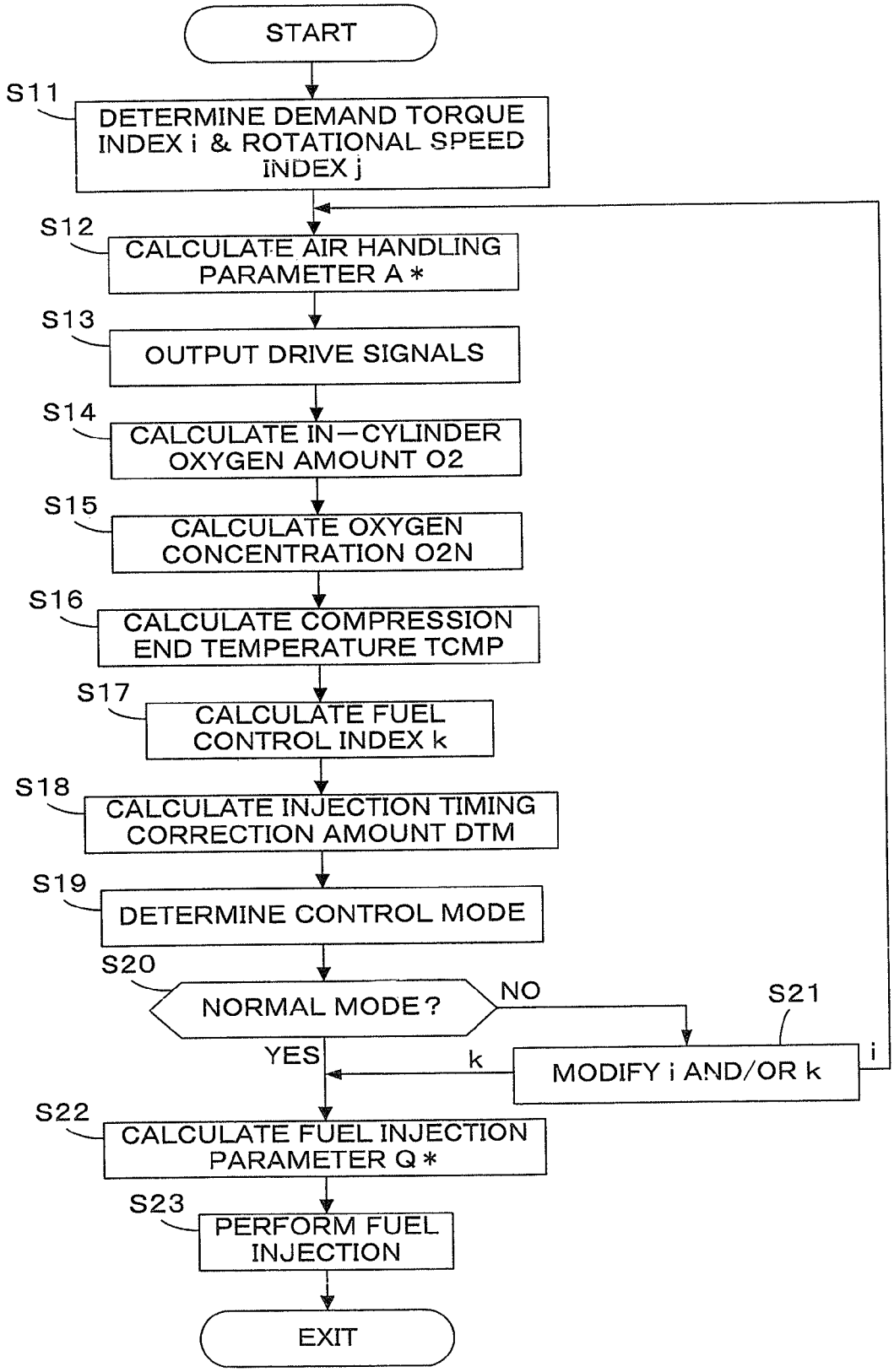
FIG. 3 is a flowchart showing an outline of a control process performed by the control system shown in FIG. 2.

FIG. 3 is a flowchart illustrating an exemplary control method in this embodiment.

Figure 4:
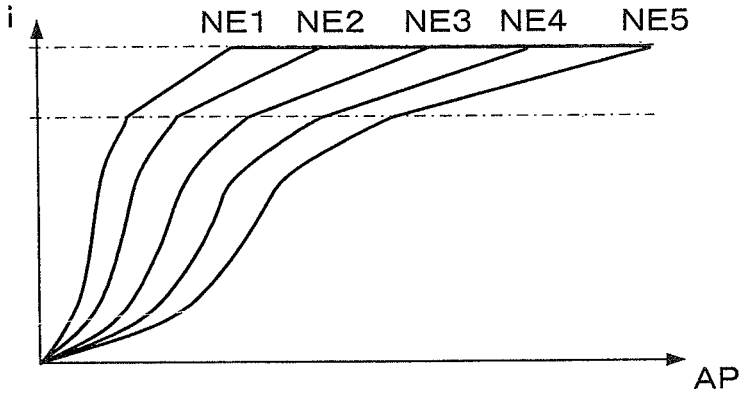
FIG. 4 is a table used for calculating a demand torque index (i)

First, in step S11, an "i" table shown in FIG. 4 is retrieved according to the engine rotational speed NE and the accelerator pedal cperation amount AP to calculate a demand torque index i. Further, a rotational speed index j is calculated according to the engine rotational speed NE. The "i" table shown in FIG. 4 is set corresponding to the engine rotational speed NE1 to NE5 (NE1<NE2<NE3<NE4<NE5). The "i" table is set so that the demand torque index i decreases as the engine rotational speed NE becomes higher if the accelerator pedal operation amount AP is constant.

Figure 5:
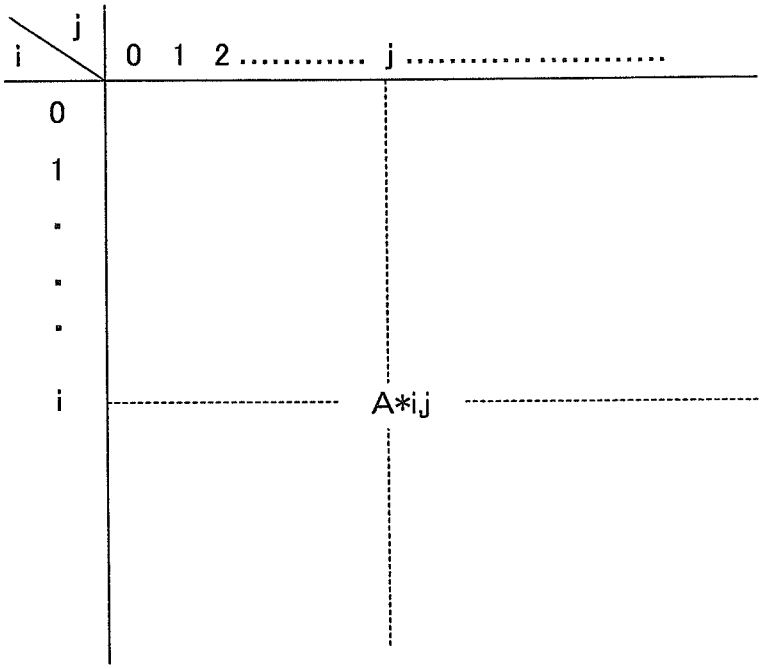
FIG. 5 is a map used for calculating an air handling parameter (A*)

In step S12, an A* map shown in FIG. 5 is retrieved according to the demand torque index i and the rotational speed index j to determine an air handling parameter A*. The air handling parameter A* is a vector having a target throttle valve opening THR, a target EGR valve opening LER, a target vane opening VOR, and a target swirl valve opening SVOR as components. At a grid point of the address (i,j) on the A* map, the target throttle valve opening THR, the target EGR valve opening LER, the target vane opening VOR, and the target swirl valve opening SVO, which are suitable for the corresponding demand torque index i and rotational speed index j, are set.

In step S13, the drive signals according to the air handling parameter A* are output to the actuator 8, the vane opening control valve 12, the swirl control valve 13, and the EGR control valve 14*b*.

Figure 6:
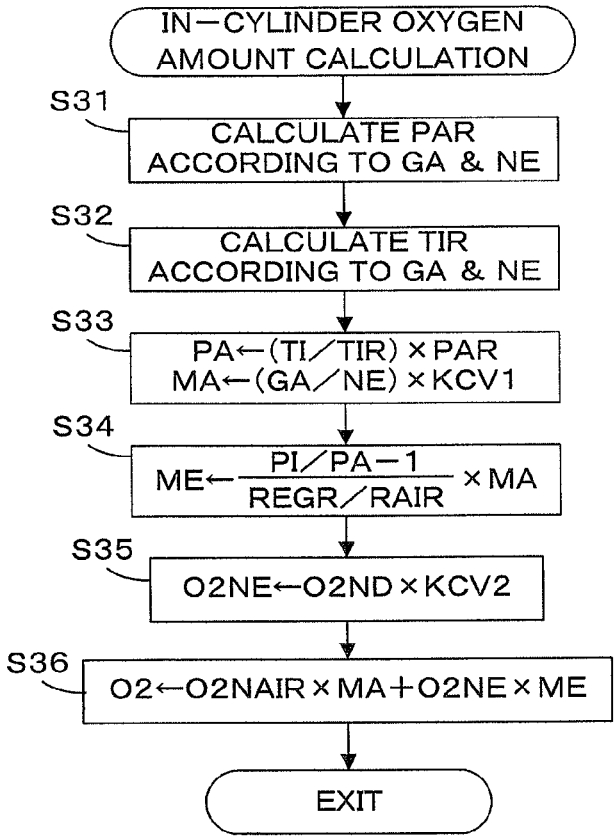
FIG. 6 is a flowchart of a method for calculating an in-cylinder oxygen amount (O2)

In step S14, an in-cylinder oxygen amount O2 is calculated in accordance with a method shown in FIG. 6. In step S31 of FIG. 6, a PAR map is retrieved according to the intake air flow rate GA and the engine rotational speed NE to calculate a reference air partial pressure PAR in the intake pipe. In step S32, a TIR map is retrieved according to the intake air flow rate GA and the engine rotational speed NE to calculate a reference intake air temperature TIR.

In step S33, the reference air partial pressure PAR is corrected using the intake air temperature TI and the reference intake air temperature TIR to calculate an air partial pressure PA in the intake pipe using equation (1). The intake air flow rate GA and the engine rotational speed NE (rpm) are applied to equation (2) to calculate a fresh air amount MA taken in the cylinder within one TDC period (a period of 180-degree rotation of the crank angle when the engine is a four-cylinder engine). KCV1 in equation (2) is a conversion coefficient.

$$PA=(TI/TIR)\times PAR \tag{1}$$

$$MA=(GA/NE)\times KCV1 \tag{2}$$

In step S34, the intake pressure PI, the air partial pressure PA, and the fresh air amount MA are applied to equation (3) to calculate a recirculated exhaust amount ME.

$$ME = \frac{PI/PA - 1}{REGR/RAIR} \times MA \tag{3}$$

where REGR and RAIR are gas constants, respectively, of the recirculated exhaust gas and of air.

Equation (3) is obtained by using equation (4). PE in equation (4) is a recirculated exhaust partial pressure in the intake pipe and VI is an intake pipe volume.

$$\frac{PI}{PA} = \frac{PA + PE}{PA} = \frac{(MA \cdot RAIR + ME \cdot REGR)(TI/VI)}{MA \cdot RAIR(TI/VI)} \tag{4}$$

-continued $$= 1 + \frac{ME \cdot REGR}{MA \cdot RAIR}$$

In step S35, the detected oxygen concentration O2ND is applied to equation (5) to calculate an oxygen concentration O2NE in the recirculated exhaust gas. KCV2 in equation (5) is a conversion coefficient for converting a concentration based on the number of molecules into a concentration based on mass and set to a ratio (28.8/32) of an equivalent molecular weight of the exhaust gas to a molecular weight of oxygen. Since the equivalent molecular weight of the exhaust gas is substantially equal to the equivalent molecular weight of air irrespective of the air-fuel ratio, "28.8" is applied as the equivalent molecular weight of the exhaust gas.

$$O2NE = O2ND \times KCV2 \quad (5)$$

In step S36, the fresh air amount MA, the recirculated exhaust amount ME, and the oxygen concentration O2NE are applied to equation (6) to calculate the in-cylinder oxygen amount O2. O2NAIR in equation (6) is an oxygen concentration in air (mass concentration).

$$O2 = O2NAIR \times MA + O2NE \times ME \quad (6)$$

Referring back to FIG. 3, in step S15, an in-cylinder oxygen concentration O2N before fuel injection is calculated using equation (7).

$$O2N = O2/(MA+ME) \quad (7)$$

In step S16, a compression end temperature TCMP is calculated using equation (11). The compression end temperature TCMP is an estimated value of a temperature in the cylinder when the piston 3*b* of the engine is in the vicinity of the compression top dead center. The intake air temperature TI expressed in the absolute temperature is applied to equation (11).

$$TCMP = TI \times \epsilon^{n-1} \quad (11)$$

In equation (11), $\epsilon$ is an actual compression ratio, which is calculated by applying the intake air temperature TI, the intake pressure PI, and the fresh air amount MA to equation (12). In equation (12), RAIR is the gas constant and VTDC is a cylinder volume when the piston is at the compression top dead center.

$$\epsilon = (RAIR \times TI/PI)/(VTDC/MA) \quad (12)$$

Further, "n" in equation (11) is a polytropic index, which is calculated by applying the intake air temperature TI, the engine coolant temperature TW, and the engine rotational speed NE to equation (13). Coefficients k0 to k3 in equation (13) are empirically obtained.

$$n = k0 + k1 \times TI + k2 \times TW + k3 \times NE \quad (13)$$

It is to be noted that a compression ratio $\epsilon$M (e.g., 16.7), which is mechanically determined, may be applied to equation (11) instead of the actual compression ratio $\epsilon$ obtained by equation (12).

In step S17, a fuel control index k is calculated according to the in-cylinder oxygen amount O2.

Figure 7:
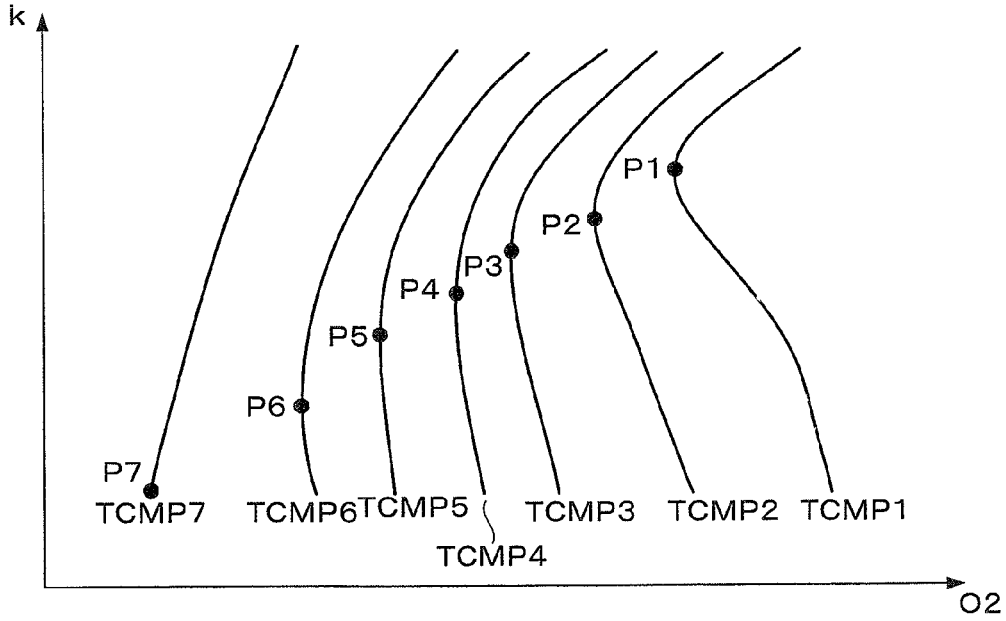
FIG. 7 is a graph illustrating the relationship between the in-cylinder oxygen amount (O2) and a fuel control index (k)

FIG. 7 shows relationships between the in-cylinder oxygen amount O2 with which a stable combustion state can be obtained and the fuel control index k (the engine rotational speed NE is constant). Curves illustrated in FIG. 7 correspond, respectively, to compression end temperatures TCMP1 to TCMP7 (TCMP1<TCMP2<TCMD3<TCMP4<TCMP5<TCMP6<TCMP7) in this order from the right side of FIG. 7. When the compression end temperature TCMP is high (TCMP=TCMP7), the fuel control index k can be set substantially proportional to the in-cylinder oxygen amount O2. However, when the compression end temperature TCMP is low, there are two values of the fuel control index k which are desirable with respect to one value of the in-cylinder oxygen amount O2. Therefore, in this embodiment, the in-cylinder oxygen amount O2 (the minimum in-cylinder oxygen amount with which a stable combustion state can be obtained) corresponding to the points P1 to P7, where the in-cylinder oxygen amount O2 becomes minimum, is defined as a critical oxygen amount O2C, and the corresponding fuel control index k is defined as a critical fuel control index kC.

When the in-cylinder oxygen amount O2 is equal to or greater than the critical oxygen amount O2C, an O2-based control is performed, wherein the fuel control index k is calculated according to the in-cylinder oxygen amount O2. When the in-cylinder oxygen amount O2 is less than the critical oxygen amount O2C, a pedal-based control is performed, wherein the fuel control index k is calculated according to the accelerator pedal operation amount AP. In the pedal-based control, the fuel control index k is controlled to increase as the accelerator pedal operation amount AP increases.

When the in-cylinder oxygen amount O2 gradually decreases to reach the critical oxygen amount O2C, the O2-based control immediately shifts to the pedal-based control. When the pedal-based control is performed and the accelerator pedal operation amount AP increases so that the pedal-based control should be switched to the O2-based control, the switching is performed when a transition condition for avoiding a torque shock is satisfied.

Next, the calculation method of the fuel control index k by the O2-based control is described below. In the O2-based control, the fuel control index k is calculated by the method shown in FIG. 8 according to the in-cylinder oxygen amount O2, the engine rotational speed NE, and the compression end temperature TCMP.

In step S41, a TCMPS map is retrieved according to the engine rotational speed NE and the in-cylinder oxygen amount O2 to calculate a reference compression end temperature TCMPS. In the TCMPS map, the compression end temperatures in the steady state are previously set according to the engine rotational speed NE and the in-cylinder oxygen amount O2 as the reference compression end temperature TCMPS.

In step S42, an O2C map and a kC map are retrieved according to the engine rotational speed NE and the reference compression end temperature TCMPS to calculate a reference critical oxygen amount O2CS and a reference critical fuel control index kCS. The reference critical oxygen amount O2CS is a critical oxygen amount in the steady state and the reference critical fuel control index kCS is a critical fuel control index in the steady state. In the O2C map, the critical oxygen amount O2C is previously set according to the engine rotational speed NE and the compression end temperature TCMP. In the kC map, the critical fuel control index kC is previously set according to the engine rotational speed NE and the compression end temperature TCMP.

In step S43, the O2C map and the kC map are retrieved according to the engine rotational speed NE and the compression end temperature TCMP calculated in step S16 of FIG. 3 to calculate the critical oxygen amount O2C and the critical fuel control index kC corresponding to the present engine operating condition.

In step S44, the reference critical oxygen amount O2CS, the critical oxygen amount O2C, and the in-cylinder oxygen amount O2 are applied to equation (25), to calculate an equivalent oxygen amount O2EQ. In equation (25), O2MAX is a maximum oxygen amount determined according to the engine rotational speed NE. The equivalent oxygen amount O2EQ corresponds to an oxygen amount obtained by converting the in-cylinder oxygen amount O2 into an oxygen amount at the reference compression end temperature TCMPS.

$$O2EQ = (O2\text{MAX} - O2CS)\frac{O2 - O2C}{O2\text{MAX} - O2C} + O2CS \tag{25}$$

In step S45, a kEQ map is retrieved according to the engine rotational speed NE and the equivalent oxygen amount O2EQ to calculate an equivalent fuel control index kEQ at the reference compression end temperature TCMPS. The kEQ map is obtained by mapping the function k=fL1(O2) corresponding to the curve L1 of FIG. 9 described below with respect to a plurality of engine rotational speeds NE. The equivalent fuel control index kEQ corresponds to fL1(O2EQ) as shown in FIG. 9.

In step S46, the equivalent fuel control index kEQ, the reference critical fuel control index kCS, and the critical fuel control index kC are applied to equation (26) to calculate the fuel control index k. kMAX in equation (26) is a fuel control index corresponding to the maximum oxygen amount O2MAX.

$$k = (kMAX - kC)\frac{kEQ - kCS}{kMAX - kCS} + kC \tag{26}$$

Figure 8:
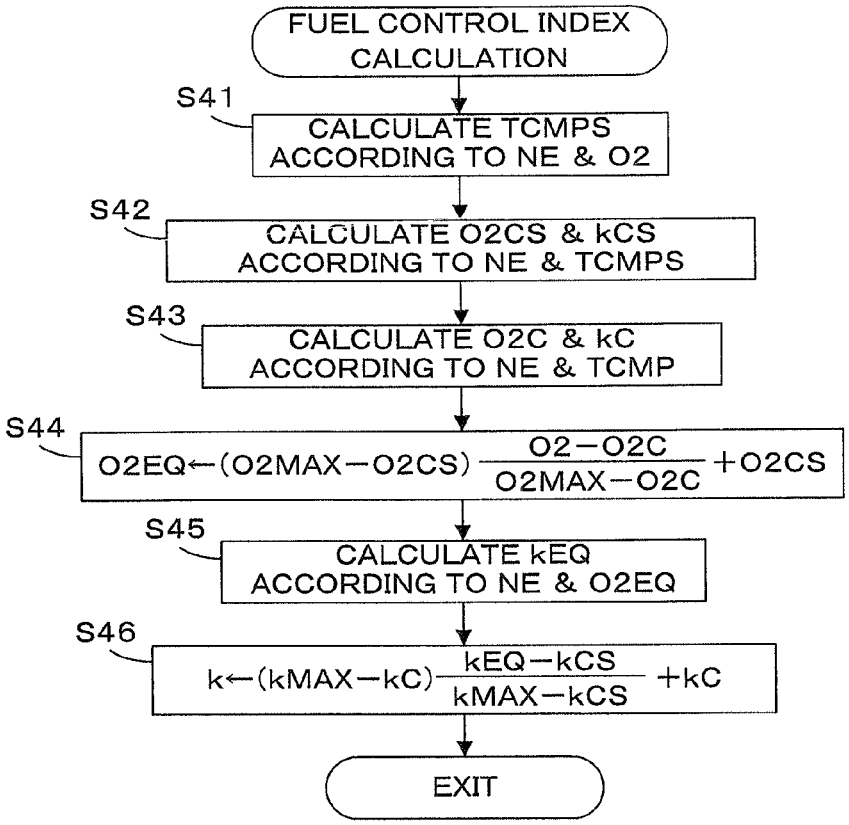
FIG. 8 is a flowchart of a method for calculating the fuel control index (k)
Figure 9:
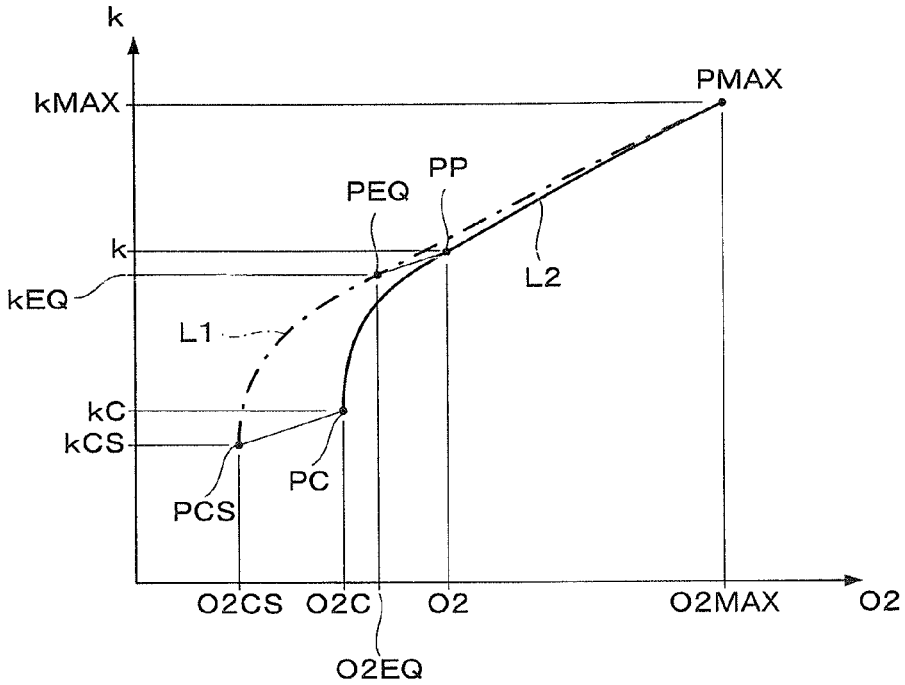
FIG. 9 is a graph illustrating a method for calculating the fuel control index (k)

FIG. 9 is a graph illustrating a calculation method of the fuel control index k in the process of FIG. 8. The curve L1 shown in FIG. 9 indicates a relationship (referred to as "O2-k curve") between the in-cylinder oxygen amount O2 corresponding to the reference compression end temperature TCMPS (the engine rotational speed is constant) and the fuel control index k. The curve L2 shown in FIG. 9 indicates the O2-k curve corresponding to the present compression end temperature TCMP. The curve L2 is obtained by shifting the critical point PCS of the curve L1 to the point PC and transforming the form of the curve with geometric similarity (Isomorphic Transformation). Using the method of FIG. 8, the equivalent oxygen amount O2EQ and the equivalent fuel control index kEQ (point PEQ) in the steady state are calculated first. Next, the isomorphic transformation is applied to the equivalent oxygen amount O2EQ and the equivalent fuel control index kEQ to calculate a fuel control index k corresponding to the point PP. It is to be noted that the fuel control index kMAX suitable for the maximum oxygen amount O2MAX (the in-cylinder oxygen amount corresponding to a condition where the exhaust gas recirculation is not performed) is not dependent on the compression end temperature TCMP.

Figure 10:
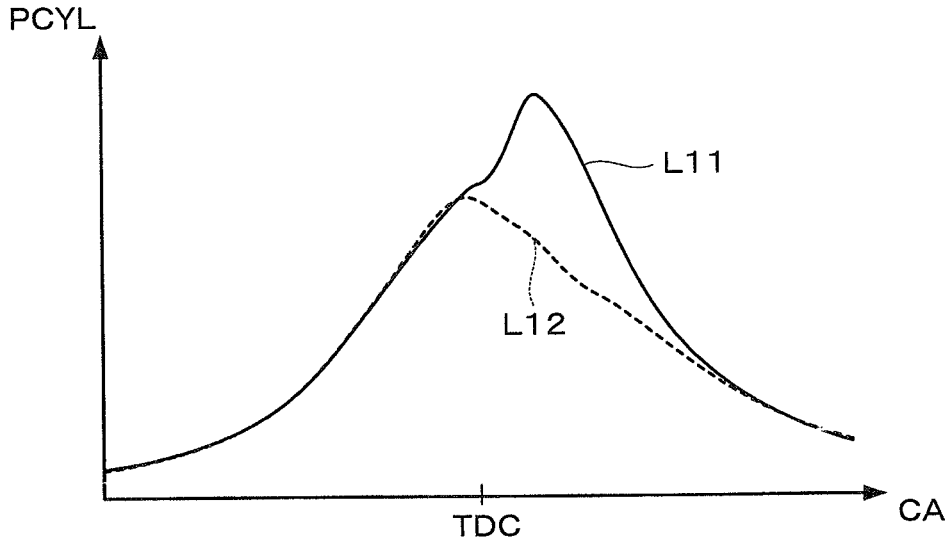
FIG. 10 is a chart showing the changes in a cylinder pressure (PCYL)

FIG. 10 is a chart showing the changes in a cylinder pressure PCYL (a pressure in the cylinder of the engine) in a condition where the engine coolant temperature TW is comparatively low (40° C.). In FIG. 10, the solid line L11 corresponds to this embodiment, and the dashed line L12 corresponds to a case in which the fuel control index k is set without taking the compression end temperature TCMP into consideration. The horizontal axis represents the crank angle CA. In this embodiment, the fuel control index k is calculated according to the compression end temperature TCMP in addition to the engine rotational speed NE and the in-cylinder oxygen amount O2. Therefore, the combustion state of the engine is further stabilized, especially when the engine temperature is low.

According to the calculated fuel control index k and the rotational speed index j, a fuel injection parameter Q* is calculated in step S22 of FIG. 3 as described below. The fuel injection parameter Q* consists of an injection pressure PF, a pilot injection amount QIP, a main injection amount QIM, a pilot injection timing TMP, and a main injection timing TMM. When performing the single injection, the pilot injection amount QIP is set to "0", and the pilot injection is not performed. The fuel injection amount QINJ (=QIP+QIM) is set to increase as the fuel control index k increases.

Figure 11:
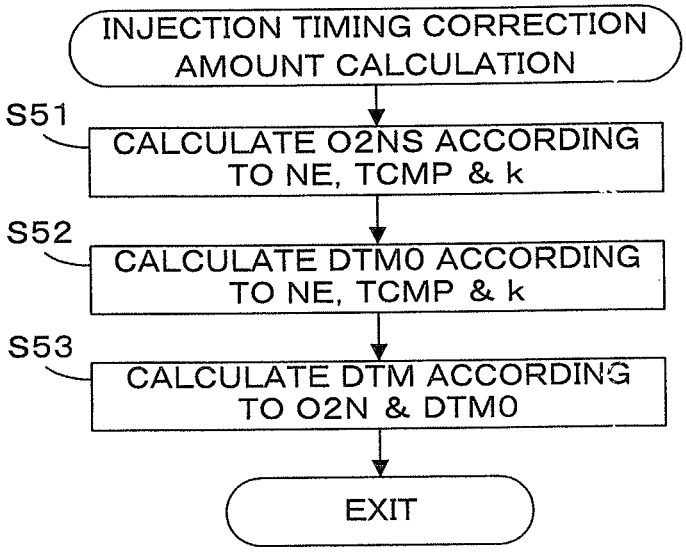
FIG. 11 is a flowchart of a method for calculating a fuel injection timing correction amount (DTM)

In step S18 of FIG. 3, an injection timing correction amount DTM is calculated with a method shown in FIG. 11. The main injection timing TMM included in the fuel injection parameter Q* is set corresponding to an oxygen concentration O2NS in the cylinder in the steady state. The combustion noise is likely to increase as a deviation of the actual oxygen concentration O2N from the steady state oxygen concentration O2NS becomes greater. Therefore, in this embodiment, the injection timing correction amount DTM is calculated according to the oxygen concentration O2N to correct the main injection timing TMM of the fuel injection parameter Q*. A great deviation of the oxygen concentration O2N is likely to occur immediately after termination of the fuel cut operation.

In step S51 of FIG. 11, the steady state oxygen concentration O2NS is calculated according to the engine rotational speed NE, the compression end temperature TCMP, and the fuel control index k.

Figure 12:
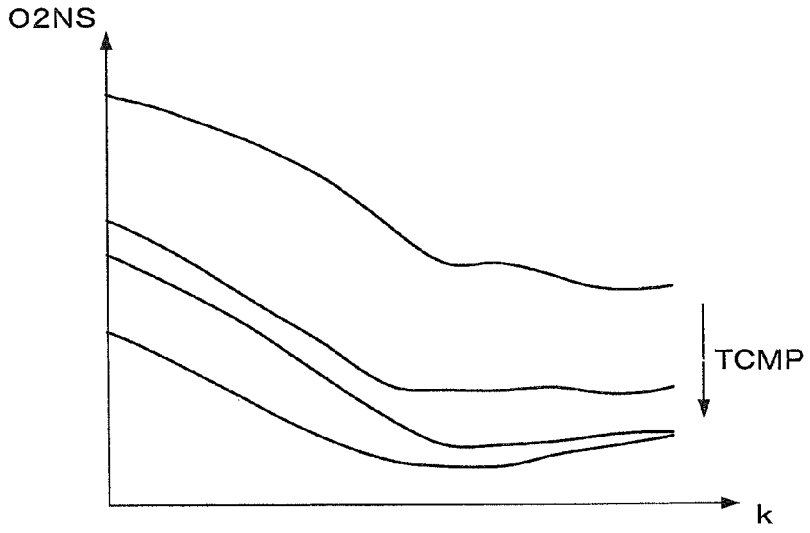
FIG. 12 is a graph illustrating the relationship between the fuel control index (k) and a steady state oxygen concentration (O2NS)

Specifically, an O2NS map, as shown in FIG. 12, is selected according to the engine rotational speed NE, and the O2NS map is retrieved according to the compression end temperature TCMP and the fuel control index k to calculate the steady state oxygen concentration O2NS. The O2NS map is set so that the steady state oxygen concentration O2NS decreases as the compression end temperature TCMP becomes higher.

Figure 13:
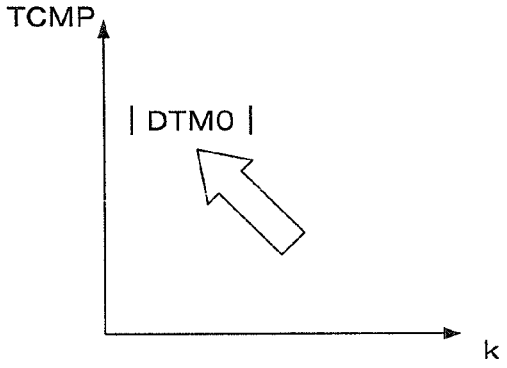
FIG. 13 is a map used for calculating a zero EGR correction amount (DTM0) of the fuel injection timing.

In step S52, a DTM0 map is selected according to the engine rotational speed NE, and the DTM0 map shown in FIG. 13 is retrieved according to the compression end temperature TCMP and the fuel control index k to calculate an injection timing correction amount DTM0 (hereinafter referred to as "zero EGR correction amount") in the condition where the exhaust gas recirculation is not performed (the condition where the oxygen concentration is equal to an oxygen concentration O2NAIR of air). The zero EGR correction amount DTM0 takes a negative value to retard the injection timing. The DTM0 map is set so that the absolute value of the zero EGR correction amount DTM0 increases (a retard correction amount increases) as the compression end temperature TCMP becomes higher and the fuel control index k decreases.

Figure 14:
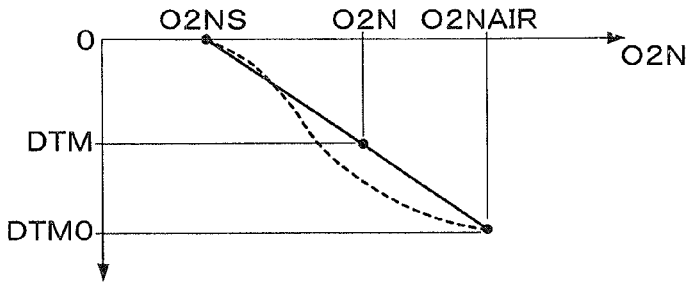
FIG. 14 is a graph showing a relationship between an oxygen concentration (O2N) and the fuel injection timing correction amount (DTM)

In step S53, the injection timing correction amount DTM is calculated according to the oxygen concentration O2N and the zero EGR correction amount DTM0. This calculation is performed by a simple linear interpolation as shown in FIG. 14 (the solid line) or by retrieving a previously set DTM table (shown by the dashed line in FIG. 14).

In this embodiment, in a predetermined range where the value of the fuel control index k is comparatively great (e.g., from "11" to "14"), the double injection (pilot injection+main injection) is performed. In this case, the injection timing correction amount DTM is applied to a correction of the main injection timing.

By correcting the fuel injection timing according to the oxygen concentration O2N, the combustion noise is significantly reduced immediately after termination of the fuel cut operation.

It is to be noted that when performing the single injection and when the absolute value |DTM| of the correction amount is equal to or greater than a predetermined value, the injection may be changed to a double injection and the main injection timing may be corrected according to the injection timing correction amount DTM.

Figure 15:
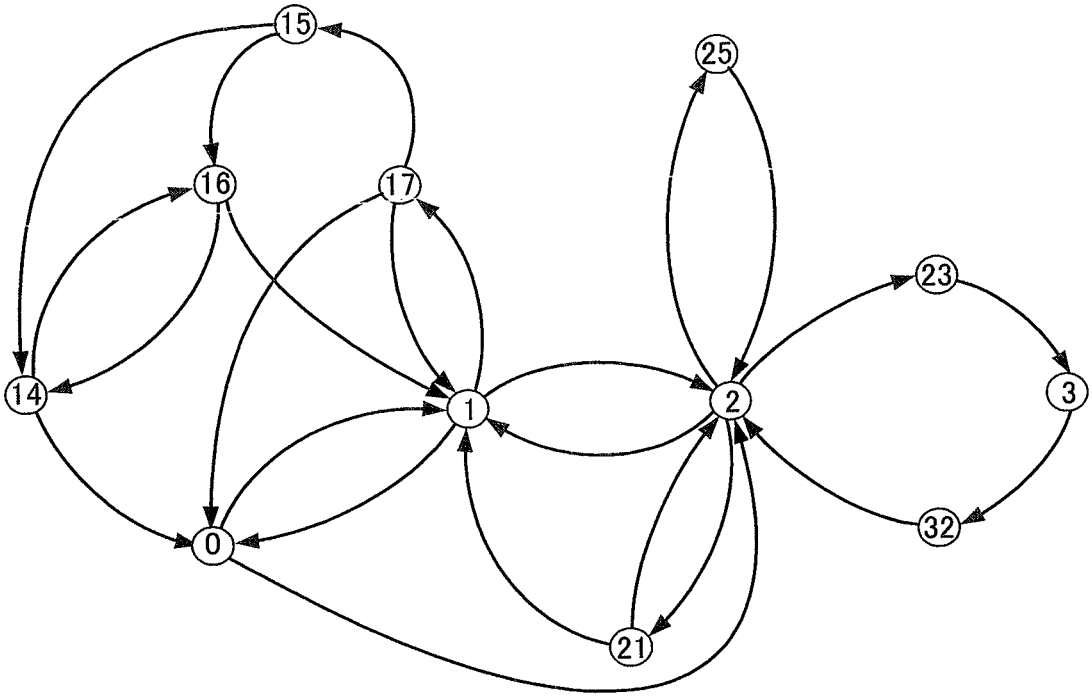
FIG. 15 is a state transition diagram showing relationships among control modes of the engine.

Referring back to FIG. 3, in step S19, a control mode is determined according to the various parameters described above. Main control modes of the engine 3 are an idle mode (mode 0), a low load mode (mode 1), a normal mode (mode 2) and a regeneration rich mode (mode 3). Further, a high load mode (mode 25), wherein an amount of fuel is increased more than that of the normal mode, and a deceleration rich mode (mode 15), wherein regeneration of the NOx absorbent catalyst 17 (reduction of absorbed NOx) is performed during deceleration of the engine 3, are employed. In addition, a normal-to-low load transition mode (mode 21), a normal-to-rich transition mode (mode 23), a rich-to-normal transition mode (mode 32), a low load-to-deceleration rich transition mode (mode 17), a deceleration rich-to-low load transition mode (mode 16), and a deceleration rich-to-idle transition mode (mode 14) are employed as control modes for transitioning among the above-described control modes. FIG. 15 is a state transition diagram showing relationships among these control modes.

With reference to FIG. 15, an outline of each control mode is described below.

1) Normal Mode (Mode 2).

In the normal mode, the O2-based control is performed. The air-fuel ratio is set in a lean region with respect to the stoichiometric ratio, and the exhaust gas recirculation ratio is controlled to be comparatively great or high. The air handling parameter A* is determined according to the demand torque index i and the rotational speed index j. The fuel injection parameter Q* is determined according to the fuel control index k and the rotational speed index j.

2) Idle Mode (Mode 0).

The air handling parameter A* is determined so that a desired air-fuel ratio (e.g., 19 to 21) is maintained. Further, the fuel injection parameter Q* is determined not by the O2-based control but by a combination of a feedforward term and a PID term so that the detected engine rotational speed NE coincides with a target rotational speed (e.g., 650 rpm).

3) Low Load Mode (Mode 1).

The low load mode is employed to eliminate a torque shock when the control mode shifts from mode 0 to mode 2 or vice versa. The low load mode is applied when the output torque of the engine 3 is within a range from a negative value to a value which is slightly greater than "0", and the engine is in a predetermined low load operating condition where the engine rotational speed NE is higher than the idling rotational speed.

The air handling parameter A* is determined by a fixed demand torque index i. The value of the demand torque index i is selected corresponding to the value in a predetermined range (e.g., 6 to 10) of the fuel control index k to ensure stable combustion. The fuel injection parameter Q* (fuel control index k) is determined by the pedal-based control. The fuel control index k is determined so as not to exceed the value (the value of k calculated in step S17 of FIG. 3) calculated by the O2-based control and is further controlled so that a change amount Δk between the fuel control index k corresponding to one cylinder and the fuel control index k corresponding to the next cylinder, does not exceed a predetermined limit value DKLMT. This calculation method of the fuel control index k achieves a good combustion state and enables smooth torque control and accurate torque control in a low torque region.

4) Regeneration Rich Mode (Mode 3).

The regeneration rich mode is a control mode for regenerating the NOx absorbent catalyst 17. The air-fuel ratio is controlled to be in a rich region with respect to the stoichiometric ratio. The air handling parameter A* is determined according to the demand torque index i and the rotational speed index j using a map set for the rich mode. The fuel injection parameter Q* is determined according to the fuel control index k and the rotational speed index j using a map set for the rich mode. Further, the fuel injection amount QINJ is controlled with a feedback manner so that a detected air-fuel ratio AFD calculated from the detected oxygen concentration O2ND coincides with a desired rich air-fuel ratio AFR.

5) Normal-to-Rich Transition Mode (Mode 23).

The normal-to-rich transition mode is a control mode for the transition from the normal mode to the regeneration rich mode. The air handling parameter A* is determined according to the demand torque index i and the rotational speed index j using a map set for the rich mode. The closed loop control for controlling the in-cylinder oxygen amount O2 to a target value is also performed. A target in-cylinder oxygen amount O2TR applied after transition to the regeneration rich mode is calculated. The fuel injection parameter Q* is calculated to smoothly change according to the target in-cylinder oxygen amount O2TR and the in-cylinder oxygen amount O2 in the normal mode immediately before the transition.

6) Rich-to-Normal Transition Mode (Mode 32).

The rich to normal transition mode is a control mode for the transition from the regeneration rich mode to the normal mode. The air handling parameter A* is determined according to the demand torque index i and the rotational speed index j using a map set for the normal mode. The closed loop control for controlling the in-cylinder oxygen amount O2 to a target value is also performed. A target in-cylinder oxygen amount O2TL after transition to the normal mode is calculated. The fuel injection parameter Q* is calculated to smoothly change according to the target in-cylinder oxygen amount O2TL and the in-cylinder oxygen amount O2 in the regeneration rich mode immediately before the transition.

7) High Load Mode (Mode 25).

In the normal mode, when the condition where the accelerator pedal operation amount AP is relatively large continues, the engine torque becomes insufficient for the driver's demand if only the O2-based control is performed. Therefore, when the accelerator pedal operation amount AP increases to reach a predetermined operation amount APH at which the exhaust gas recirculation is stopped, the control mode shifts form the normal mode to the high load mode.

In the high load mode, the air handling parameter A* is basically set similar to the normal mode, and the target vane opening VOR of the turbine is corrected in the increasing direction. The fuel injection parameter Q* is basically set similar to the normal mode. Further, the fuel injection amount QINJ is increased by about 10%.

8) Normal-to-Low Load Transition Mode (Mode 21).

The normal to low load transition mode is employed to rapidly reduce the in-cylinder oxygen amount O2 when the accelerator pedal operation amount AP becomes "0", thereby avoiding the state where the engine rotational speed NE is too high. As the air handling parameter A*, one of the special combinations (in this embodiment, values of "1" to "4" of the demand torque index i are assigned) which are previously set corresponding to the condition where the accelerator pedal operation amount AP is "0", is applied. The air handling parameter A* is set so that the intake pressure PI is kept at the level of at least about 70 kPa, and the value of the demand torque index i is increased or decreased as required. The target EGR valve opening LER, which is one of the elements of the air handling parameter A*, is set to decrease as the demand torque index i increases, and the target throttle valve opening THR is set to increase as the demand torque index i increases.

9) Deceleration Rich Mode (Mode 15).

Instead of performing a fuel cut operation during deceleration, fuel injection is performed, and the intake air control, the EGR control, and the fuel injection control are performed so that the injected fuel may not burn. The air handling parameter A* is calculated using a map for the deceleration rich mode which is set so that the intake pressure PI greatly decreases. The fuel injection parameter Q* is calculated according to the fuel control index k and the rotational speed index j using a map for the deceleration rich mode. The feedback control of the fuel injection amount QINJ is performed so that the detected air-fuel ratio AFD coincides with a predetermined target air-fuel ratio.

10) Low Load-to-Deceleration Rich Transition Mode (Mode 17).

The intake pressure PI is controlled to become less than a threshold value which is set for the transition to the deceleration rich mode. The air handling parameter A* is calculated using a map for the deceleration rich mode and the fuel supply is stopped.

11) Deceleration Rich-to-Low Load Transition Mode (Mode 16).

In order to avoid torque shock occurring upon the transition of the control mode, a minimum scavenging is performed for discharging residual fuel. The air handling parameter A* is calculated using a map for the deceleration rich mode and the fuel supply is stopped.

12) Deceleration Rich to Idle Transition Mode (Mode 14).

In order to avoid the torque shock occurring upon the transition of the control mode, the scavenging is performed for discharging residual fuel. The air handling parameter A* is calculated using the map for the deceleration rich mode and the fuel supply is stopped.

Next, an outline regarding the transition of the control mode is first described. If the accelerator pedal is depressed in the idle mode 0, the control mode shifts to the normal mode 2 via the low load mode 1. In the normal mode 2, if the accelerator pedal is further depressed a great amount, the control mode shifts to the high load mode 25. If the regeneration process of the NOx absorbent catalyst 17 is requested in the normal mode 2, a so-called rich spike control is performed. Specifically, in the rich spike control, the control mode shifts to the regeneration rich mode 3 via the normal-to-regeneration rich transition mode 23, and returns from the regeneration rich mode 3 to the normal mode 2 via the regeneration rich-to-normal transition mode 32. If the accelerator pedal operation amount AP decreases in the normal mode 2, the control mode shifts to the low load mode 1 via the normal-to-low load transition mode 21. If the accelerator pedal operation amount AP further decreased to become equal to or less than a predetermined value, the control mode shifts to the idle mode 0. If the engine rotational speed NE is sufficiently high and the regeneration process of the NOx absorbent catalyst 17 is requested, the control mode shifts to the deceleration rich mode 15 via the low load-to-deceleration rich transition mode 17. If the engine rotational speed NE decreases, the control mode shifts to the low load mode 1 via the deceleration rich-to-low load transition mode 16, or the control mode shifts to the idle mode 0 via the deceleration rich-to-idle transition mode 14.

Next, transition conditions of the control mode are described in detail.

A) The present control mode is the idle mode 0.

i) If the accelerator pedal operation amount AP is greater than "0" and the in-cylinder oxygen amount O2 is less than the critical oxygen amount O2C, or if the fuel control index k (preceding value) is less than a value determined according to the in-cylinder oxygen amount O2 (the value calculated in step S17 of FIG. 3 and hereinafter referred to as "O2 reference value kO"), or if the fuel control index k (preceding value) is less than the critical fuel control index kC, the control mode shifts to the low load mode 1.

ii) If the accelerator operation amount AP is greater than "0", the in-cylinder oxygen amount O2 is greater than the critical oxygen amount O2C, the fuel control index k (preceding value) is greater than the O2 reference value kO2, and the fuel control index k (preceding value) is greater than the critical fuel control index kC, the control mode directly shifts to the normal mode 2.

B) When the present control mode is the low load mode 1.

i) If the accelerator pedal operation amount AP is equal to "0", the fuel control index k (preceding value) is less than a minimum value kMIN (e.g., "1"); and a deceleration rich control preparation flag FDRR is equal to "0", or if the engine rotational speed NE is less than a minimum value in the deceleration rich mode 15 (hereinafter referred to as "mode 15 minimum rotational speed") NEMIN15 (e.g., 1200 rpm), the control mode shifts to the idle mode 0. The deceleration rich control preparation flag FDRR is set to "1" when a preprocess for performing the deceleration rich control is completed.

ii) If the accelerator pedal operation amount AP is greater than "0", the fuel control index k is greater than the O2 reference value kO2, the fuel control index k is greater than the critical fuel control index kC, and the demand torque index i (preceding value) is less than a pedal-based demand torque index iPDL, which is calculated to be substantially proportional to the accelerator pedal operation amount AP, the control mode shifts to the normal mode 2.

iii) If the accelerator pedal operation amount AP is equal to "0", the fuel control index k (preceding value) is less than the minimum value kMIN, the engine rotational speed NE is higher than the mode 15 minimum rotational speed NEMIN15, a deceleration rich execution flag FDRE is equal to "1", a deceleration rich control preparation flag FDRR is equal to "1", and a clutch-on flag FCLON is equal to "1", the control mode shifts to the low load-to-deceleration rich transition mode 17. The deceleration rich execution flag FDRE is set to "1" when the deceleration rich control is performed. The clutch-on flag FCLON is set to "1" when the clutch of the vehicle is engaged.

C) The present control mode is the normal mode 2.

i) If the in-cylinder oxygen amount O2 is less than the critical oxygen amount of O2C, the control mode shifts to the low load mode 1.

ii) If the accelerator pedal operation amount AP is equal to "0" and the in-cylinder oxygen amount O2 is greater than the critical oxygen amount O2C, the control mode shifts to the normal-to-low load transition mode 21.

iii) If the demand torque index i (preceding value) is greater than a zero EGR threshold value iEGR0, and the fuel control index k (preceding value) is less than a reference value in the steady state kS (hereinafter referred to as "steady state reference value"), the control mode shifts to the high load mode 25. The zero EGR threshold value iEGR0 is a minimum value of the demand torque index i which requires that the target EGR valve opening LER be set to "0".

iv) If the demand torque index i is greater than a minimum value in the regeneration rich mode 3 (hereinafter referred to as "mode 3 minimum value") iMIN3 (set to a value of the demand torque index i corresponding to the minimum torque which enables stable rich combustion), the demand torque index i is less than a maximum value in the regeneration rich mode (hereinafter referred to as "mode 3 maximum") iMAX3 (set to a value of the demand torque index i corresponding to the maximum torque which causes an acceptable level of smoke), a rich/lean flag FRL is equal to "1", the engine rotational speed NE is higher than a minimum value in the regeneration rich mode (hereinafter referred to as "mode 3 minimum rotational speed") NEMIN3 (a minimum rotational speed which enables stable combustion), and the engine rotational speed NE is lower than a maximum value in the regeneration rich mode (hereinafter referred to as "mode 3 maximum rotational speed") NEMAX3 (a maximum rotational speed which enables stable combustion), the control mode shifts to the normal-to-regeneration rich transition mode 23. The rich/lean flag FRL is set to "1" when the air-fuel ratio is controlled to be in the rich region with respect to the stoichiometric ratio and is set to "0" when the air-fuel ratio is controlled to be in the lean region.

D) The present control mode is the normal-to-regeneration rich transition mode 23.

i) If the demand torque index i is greater than the mode 3 minimum value iMIN3 and less than the mode 3 maximum iMAX3, the in-cylinder oxygen amount O2 is within a predetermined range suitable for the regeneration rich mode, the engine rotational speed NE is higher than the mode 3 minimum rotational speed NEMIN3 and lower than the mode 3 maximum rotational speed NEMAX3, and the detected air-fuel ratio AFD is in the vicinity of the target value in the regeneration rich mode, the control mode shifts to the regeneration rich mode 3.

ii) If at least one condition with respect to the demand torque index i and the engine rotational speed NE recited in the above item i) becomes no longer satisfied, if a rich pulse flag FRP becomes "0", or if the rich/lean flag FRL becomes "0", the control mode first shifts to the regeneration rich mode 3 (the control mode shifts to the regeneration rich-to-normal transition mode 32 immediately after the transition to mode 3). The rich pulse flag FRP is set to "1" when the pulse, which controls the air-fuel ratio to be in the rich region with respect to the stoichiometric ratio, is output.

E) The present control mode is the regeneration rich mode 3.

The control mode shifts to the regeneration rich-to-normal transition mode 32 if the demand torque index i is less than the mode 3 minimum value iMIN3 or greater than the mode 3 maximum iMAX3; if the rich pulse flag FRP is equal to "0"; if the rich/lean flag FRL is "0"; if the engine rotational speed NE is lower than the mode 3 minimum rotational speed NEMIN3 or higher than the mode 3 maximum rotational speed NEMAX3; or if the in-cylinder oxygen amount O2 is not within a predetermined range suitable for the regeneration rich mode 3.

F) The present control mode is the regeneration rich-to-normal transition mode 32.

The control mode shifts to the normal mode 2 if the in-cylinder oxygen amount O2 approaches a lean steady state value O2LS, i.e., when a relationship among the engine rotational speed NE, the accelerator pedal operation amount AP, and the calculated in-cylinder oxygen amount O2 approaches the relationship in the steady state (the preset value in the map); if the demand torque index i is less than the mode 3 minimum value iMIN3 or greater than the mode 3 maximum iMAX3; if the engine rotational speed NE is lower than the mode 3 minimum rotational speed NEMIN3 or higher than the mode 3 maximum rotational speed NEMAX3; if the rich pulse flag FRP is equal to "0"; or if a lean time period ratio RLT exceeds a maximum lean time period ratio RLTMAX, i.e., a generation period of the rich pulse reaches to a value which is sufficient for the NOx reduction (regeneration process of the NOx absorbent catalyst).

G) The present control mode is the high load mode 25.

If the demand torque index i (preceding value) is less than the zero EGR threshold value iEGR0, or if the fuel control index k (preceding value) is greater than the steady state reference value kS, the control mode shifts to the normal mode 2.

H) The present control mode is normal-to-low load transition mode 21.

i) If the in-cylinder oxygen amount O2 is less than a target value in the mode 21 (hereinafter referred to as "mode 21 target value O2T21"), the control mode shifts to the low load mode 1.

ii) If the accelerator pedal operation amount AP is greater than "0" and the in-cylinder oxygen amount O2 is greater than the mode 21 target value O2T21, the control mode shifts to the normal mode 2.

I) The present control mode is the low load-to-deceleration rich transition mode 17.

i) If the accelerator pedal operation amount AP is no longer equal to "0", the control mode shifts to the low load mode 1.

ii) If the accelerator pedal operation amount AP is equal to "0" and the engine rotational speed NE is lower than a minimum deceleration rich rotational speed NEDRMIN (e.g., 1400 rpm), the deceleration rich execution flag FDRE is equal to "0", or if the clutch-on flag FCLON is equal to "0", the control mode shifts to the idle mode 0.

iii) If the accelerator pedal operation amount AP is equal to "0" and the intake pressure PI is within a predetermined range suitable for the deceleration rich mode, the control mode shifts to the deceleration rich mode 15.

J) The present control mode is the deceleration rich mode 15.

i) If the accelerator pedal operation amount AP is not equal to "0", or if the accelerator pedal operation amount AP is not equal to "0" and the deceleration rich execution flag FDRE is equal to "0", the control mode shifts to the deceleration rich-to-low load transition mode 16.

ii) If the accelerator pedal operation amount AP is equal to "0" and an execution time period TDRE of the deceleration rich mode exceeds a predetermined time period TDREF, if the engine rotational speed NE is lower than the mode 15 minimum rotational speed NEMIN15, if the deceleration rich execution flag FDRE is equal to "0", or if the clutch-on flag FCLON is equal to "0", the control mode shifts to the deceleration rich-to-idle transition mode 14.

K) The present control mode is the deceleration rich-to-low load transition mode 16.

i) If the accelerator pedal operation amount AP is not equal to "0" and the engine rotational speed NE is lower than a minimum scavenging rotational speed NESLMIN (e.g., 1400 rpm), the control mode shifts to the low load mode 1.

ii) If the accelerator pedal operation amount AP is not equal to "0" and a value of a scavenging counter CSC is less than "1" (i.e., a required scavenging is completed and the value of the scavenging counter CSC is no longer equal to "1"), which indicates that execution of the scavenging is requested, the control mode shifts to the low load mode 1. The scavenging counter CSC is set to a value other than "1" when a predetermined delay time period for preventing the torque change upon the mode transition has elapsed.

iii) If the accelerator pedal operation amount AP is equal to "0", the control mode shifts to the deceleration rich-to-idle transition mode 14.

L) The present control mode is the deceleration rich-to-idle transition mode 14.

i) If the accelerator pedal operation amount AP is not equal to "0", the control mode shifts to the deceleration rich-to-low load transition mode 16.

ii) If the accelerator pedal operation amount AP is equal to "0" and a scavenging execution time period TSCAV exceeds a predetermined time period TSREF, if the engine rotational speed NE is lower than the minimum deceleration rich rotational speed NEDRMIN, or if the clutch-on flag FCLON is equal to "0", the control mode shifts to the idle 0.

Figure 16:
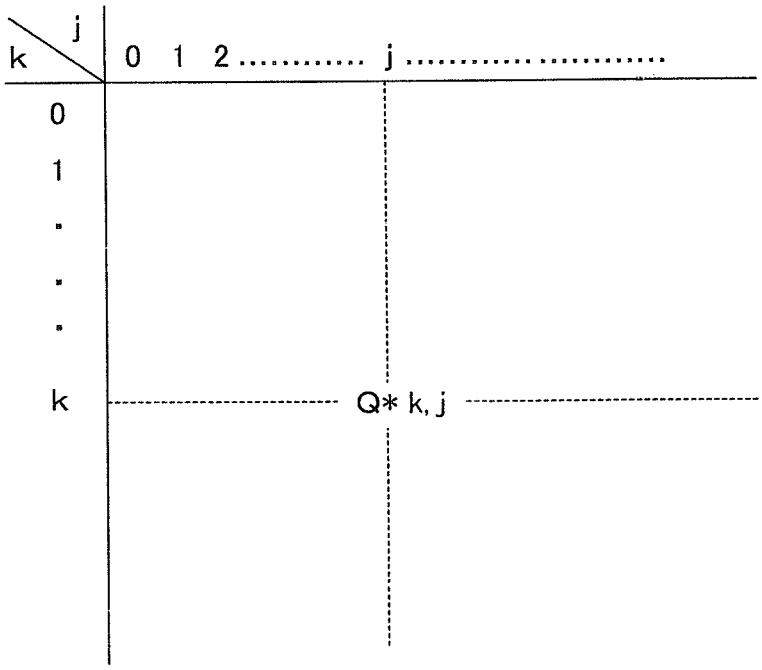
FIG. 16 is a map used for calculating a fuel injection parameter (Q*)

Referring back to FIG. 3, after the control mode is determined in step S19, it is determined in step S20 whether the determined control mode is the normal mode 2. If the answer to step S20 is affirmative (YES), a Q* map shown in FIG. 16 is retrieved according to the fuel control index k and the rotational speed index j to calculate a fuel control parameter Q* (step S22). In this calculation, the injection timing correction amount DTM calculated in step S18 is applied. Subsequently, the fuel injection according to the fuel injection parameter Q* is performed (step S23). At a grid point of the address (k,j) on the Q* map, the injection pressure PF, the pilot injection quantity QIP, the main injection amount QIM, the pilot injection timing TMP, and the main injection timing TMM, suitable for the corresponding fuel control index k and rotational speed index j, are set. In step S23, the fuel injection is performed according to these parameters.

If the answer to step S20 is negative (NO), i.e., the control mode is other than the normal mode 2, the demand torque index i and/or the fuel control index k are modified to values suitable for the corresponding control mode (step S21). The air handling parameter A* is calculated according to the modified demand torque index i (step S12) and the fuel injection parameter Q* is calculated according to the modified fuel control index k (step S22). If the demand torque index i or the fuel control index k is not modified, the original demand torque index i or fuel control index k is applied to the calculation of the air handling parameter A* or the calculation of the fuel injection parameter Q*.

Next, the low load mode 1 is more specifically described.

In the low load operating condition of the engine, the combustion state may become unstable if the O2-based control is applied as it is. Therefore, in this embodiment, the fuel control index k is determined by the pedal-based control in the low load mode 1.

Figure 17:
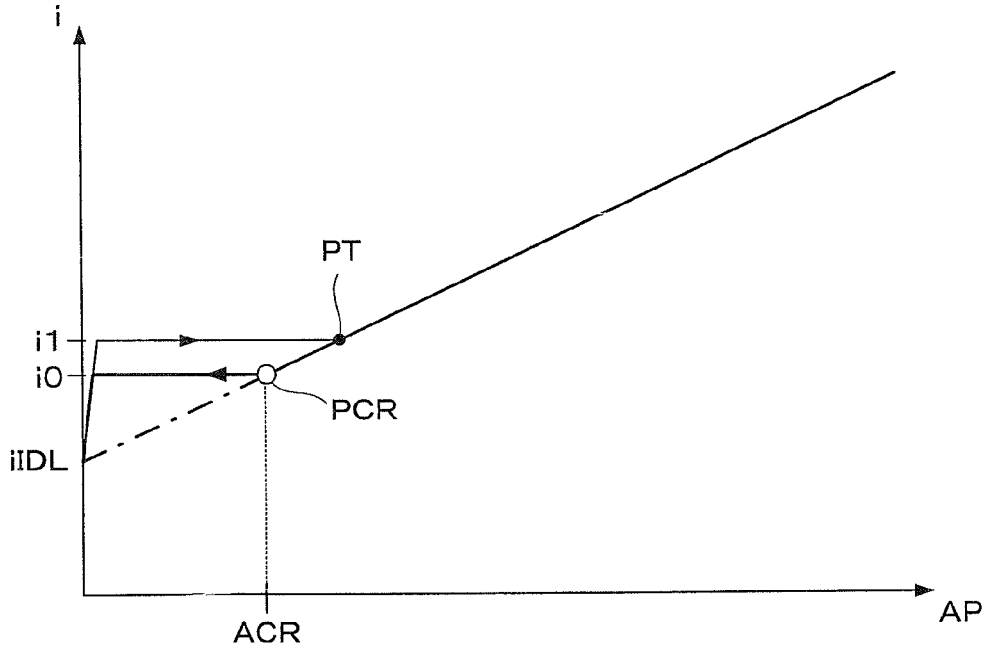
FIG. 17 is a graph used for setting of the demand torque index (i) in the low load mode.

FIG. 17 is a diagram showing a relationship between the accelerator pedal operation amount AP to the demand torque index i. The point PCR in FIG. 17 corresponds to a state where the in-cylinder oxygen amount O2 has reached the critical oxygen amount O2C. Specifically, until the accelerator pedal operation amount AP decreases to reach the critical value APCR, the demand torque index i is set to be substantially proportional to the accelerator pedal operation amount AP and is fixed to a value i0 corresponding to the critical value APCR after the accelerator pedal operation amount AP reaches the critical value APCR. By setting the demand torque index i accordingly, the oxygen amount enabling the stable combustion state is secured. The demand torque index i is set to a predetermined value iIDL for idling when the accelerator pedal operation amount AP becomes "0".

Figure 18:
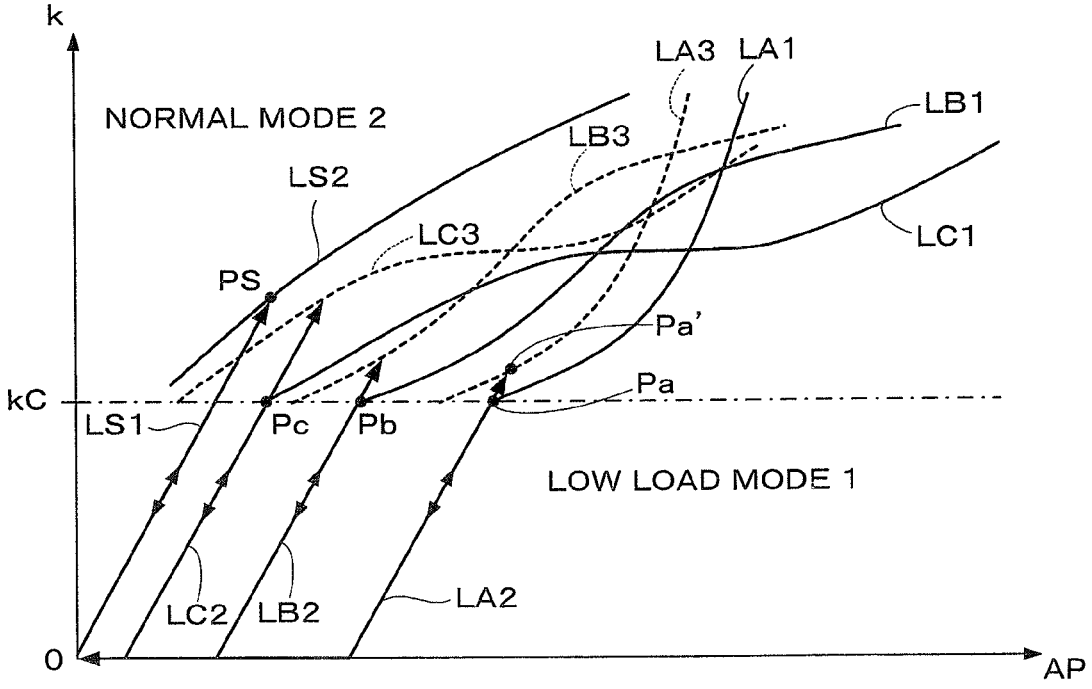
FIG. 18 is a graph illustrating transitions from the normal mode to the low load mode and transitions from the low load mode to the normal mode.
Figure 19A:
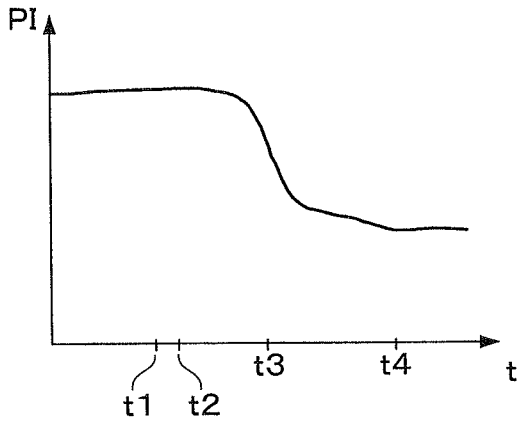
FIGS. 19A-19E are time charts illustrating changes in the engine operating parameters (PI, GA, O2, NE) upon transition from the high load mode to the idle mode.
Figure 19B:
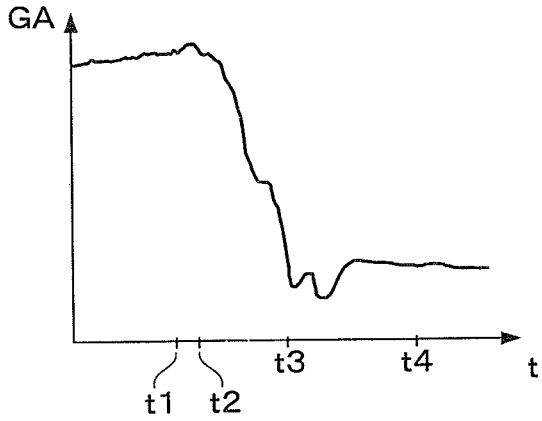
Figure 19C:
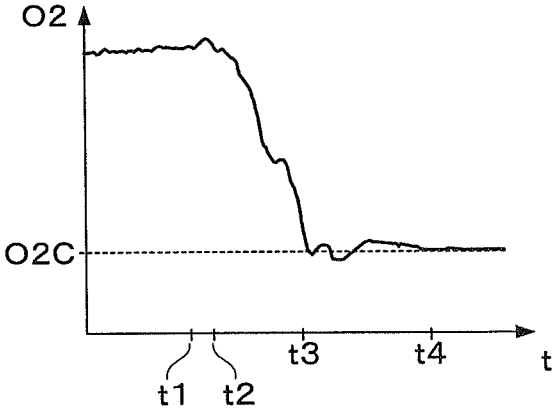
Figure 19D:
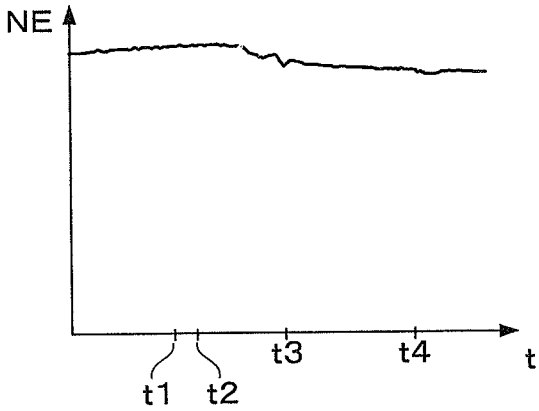
Figure 19E:
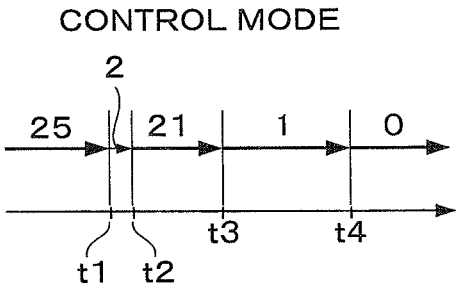
Figure 20A:
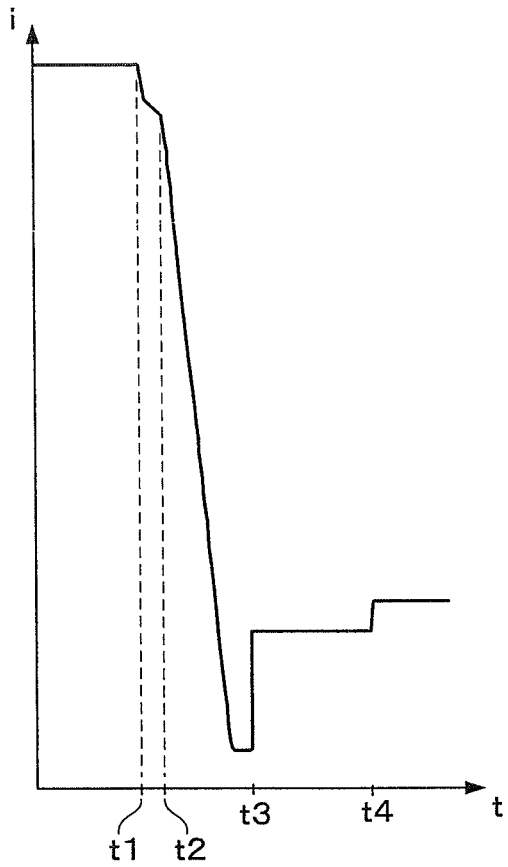
FIGS. 20A-20B are time charts illustrating changes in the control parameters (i, k) upon transition from the high load mode to the idle mode.
Figure 20B:
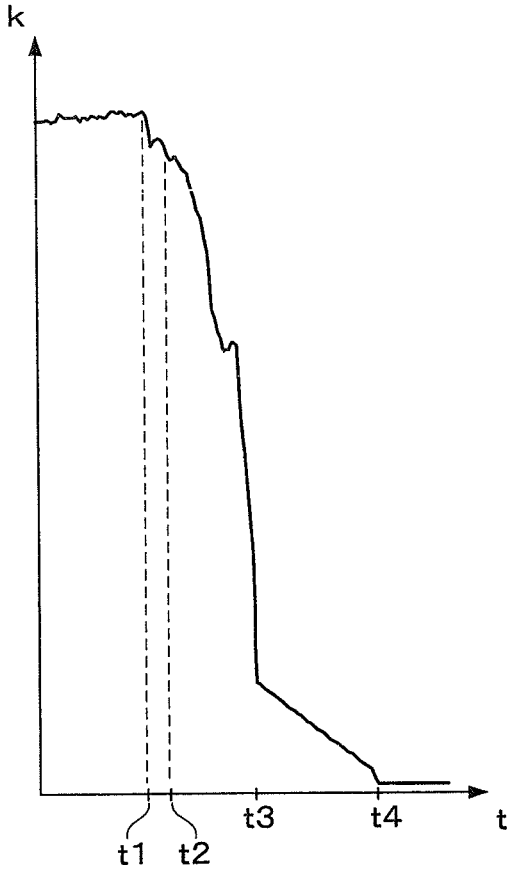
Figure 21A:
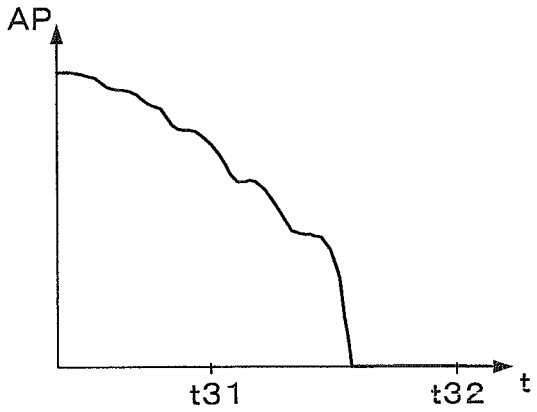
FIGS. 21A-21E are time charts illustrating changes in the engine operating parameters (AP, GA, O2, NE) upon transition from the normal mode to the idle mode.
Figure 21B:
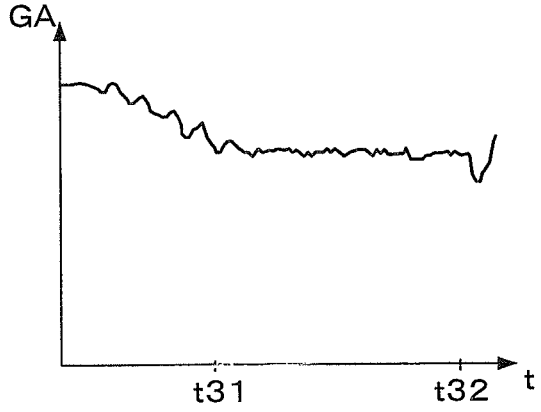
Figure 21C:
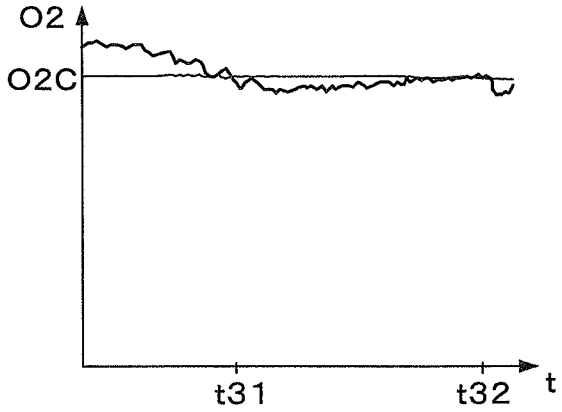
Figure 21D:
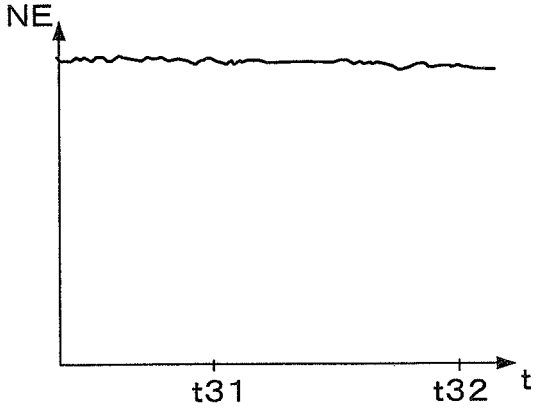
Figure 21E:
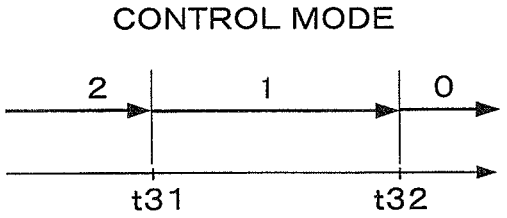
Figure 22A:
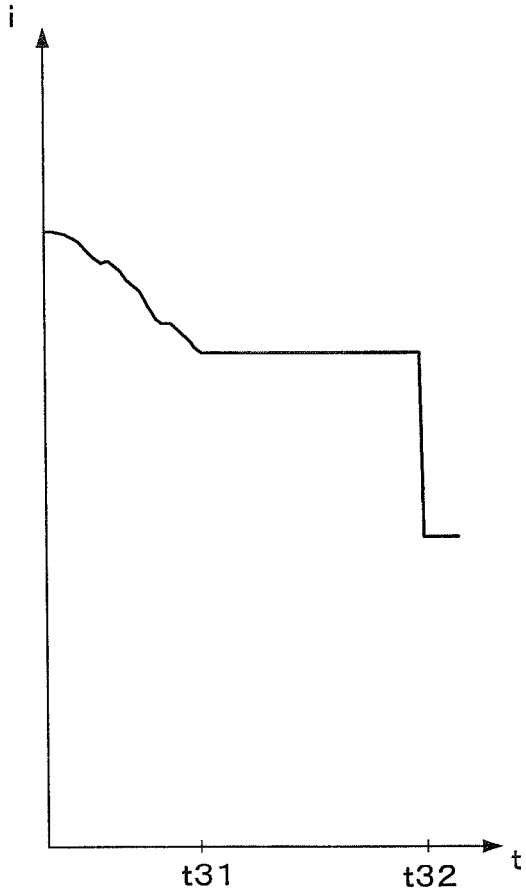
FIGS. 22A-22B are time charts illustrating changes in the control parameters (i, k) upon transition from the normal mode to the idle mode.
Figure 22B:
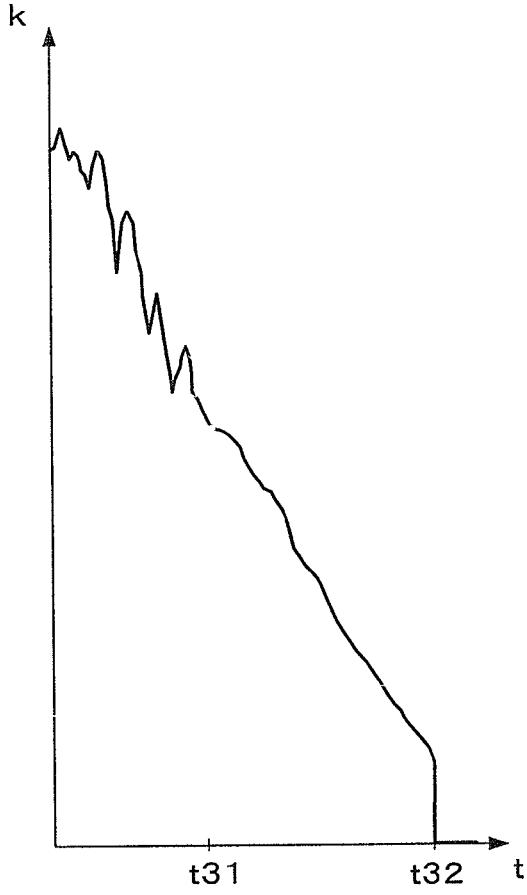
Figure 23A:
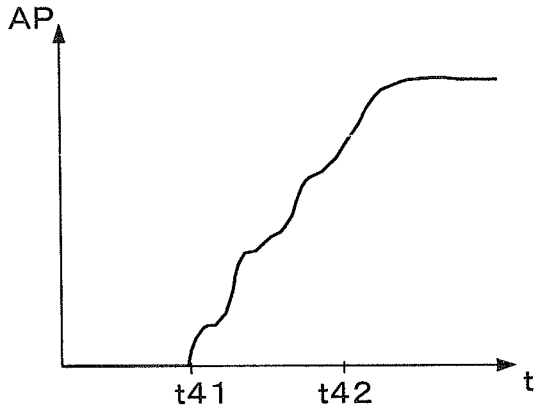
FIGS. 23A-23E are time charts illustrating changes in the engine operating parameters (AP, GA, O2, NE) upon transition from the idle mode to the normal mode.
Figure 23B:
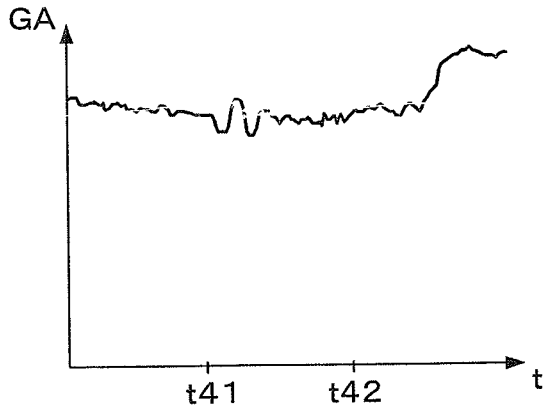
Figure 23C:
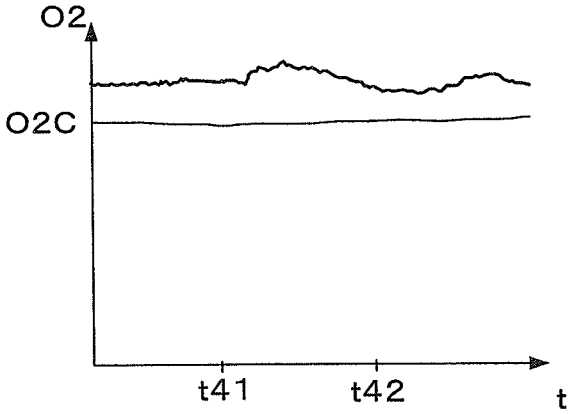
Figure 23D:
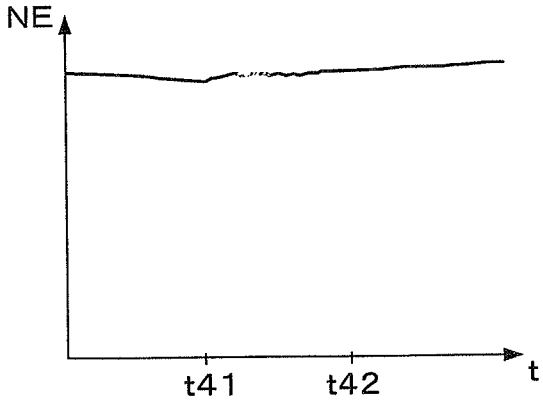
Figure 23E:
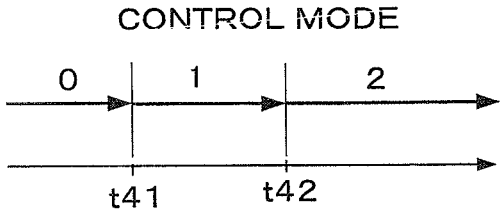
Figure 24A:
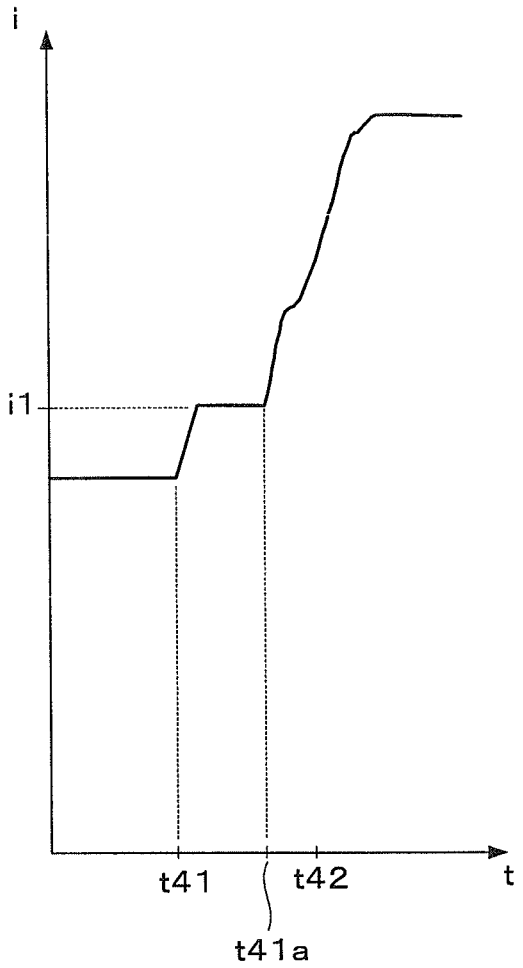
FIGS. 24A-24B are time charts illustrating changes in the control parameters (i, k) upon transition from the idle mode to the normal mode.
Figure 24B:
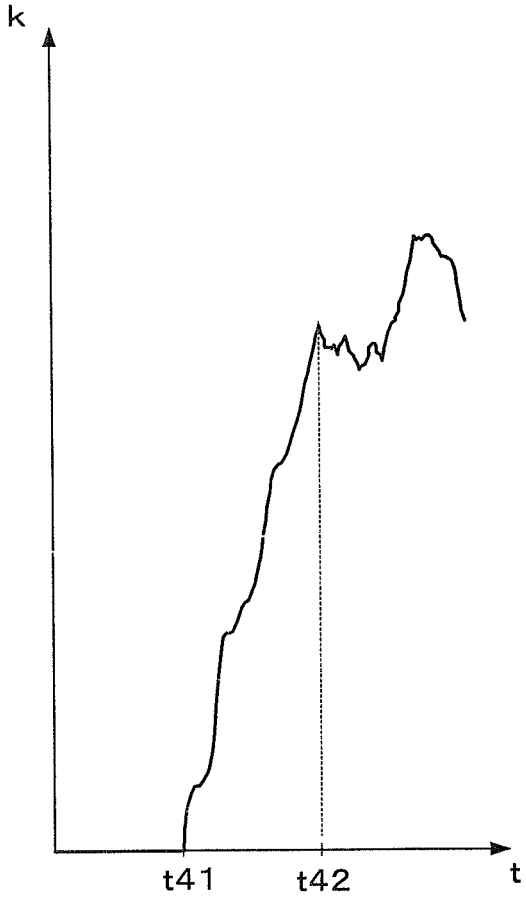
Figure 25A:
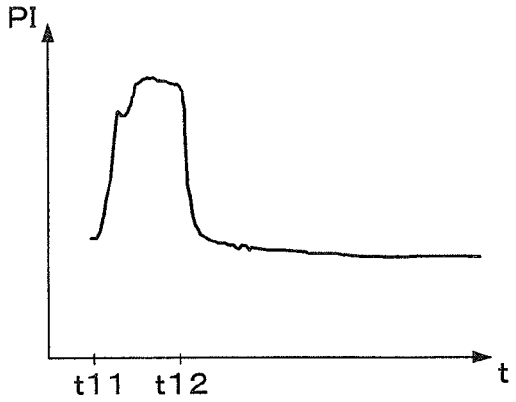
FIGS. 25A-25D are time charts illustrating changes in the engine operating parameters (PI, GA, O2) and the vehicle speed (VP) when performing the bootstrap control upon acceleration.
Figure 25B:
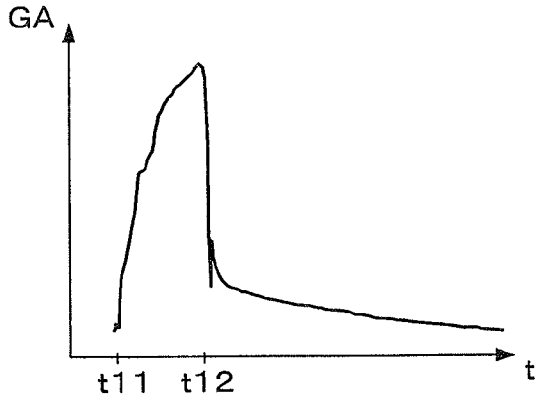
Figure 25C:
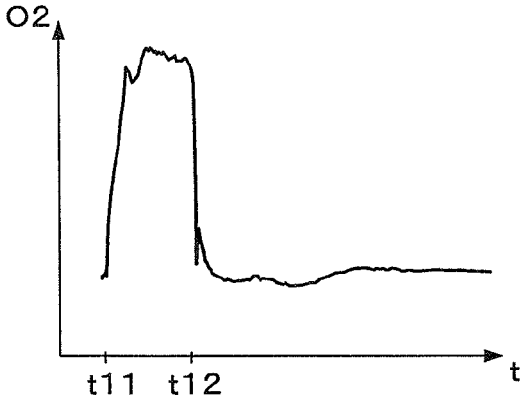
Figure 25D:
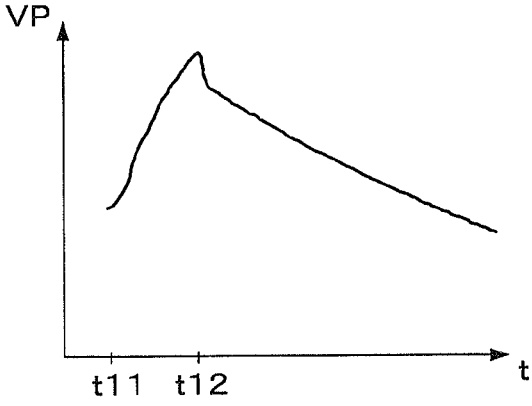
Figure 26A:
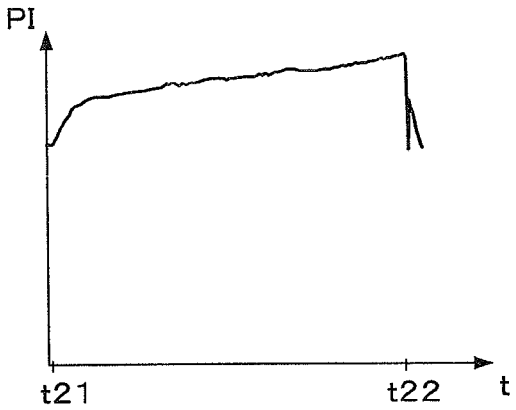
FIGS. 26A-26D are time charts illustrating changes in the engine operating parameters (PI, GA, O2) and the vehicle speed (VP) when the bootstrap control is not performed upon acceleration.
Figure 26B:
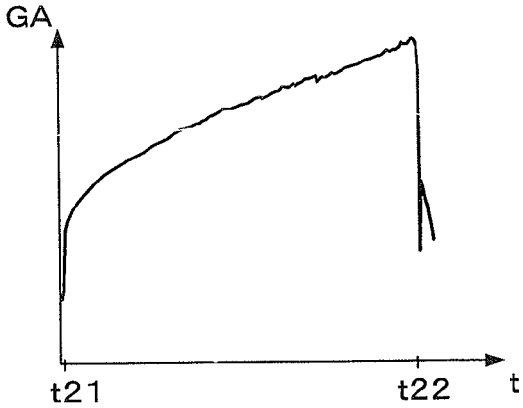
Figure 26C:
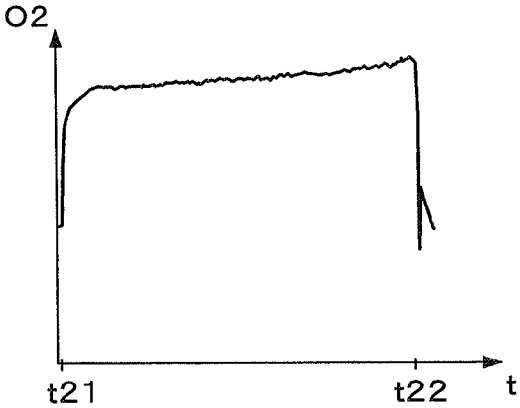
Figure 26D:
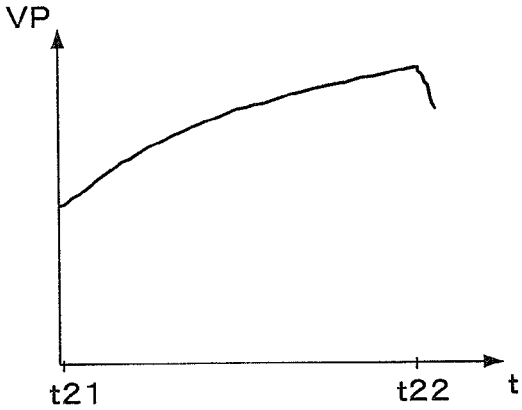

FIG. 18 is a diagram showing a relationship between the accelerator pedal operation amount AP and the fuel control index k. The solid lines LA1, LB1, and LC1 respectively correspond to different operating conditions. Each of the lines LA1, LB1 and LC1 indicates a process in which the accelerator pedal operation amount AP decreases in the normal mode 2. Regarding an example shown by the solid line LA1, a detailed explanation is described below. When the accelerator pedal operation amount AP decreases in the normal mode 2 and the in-cylinder oxygen amount O2 reaches the critical oxygen amount O2C (point Pa), the fuel control index k becomes equal to the critical fuel control index kC, and the control mode shifts to the low load mode 1. In the low load mode 1, shown by the solid line LA2, the fuel control index k is set to be proportional to the accelerator pedal operation amount AP.

As described above, when the in-cylinder oxygen amount O2 reaches the critical oxygen amount O2C, the demand torque index i is fixed to the value i0 to prevent the in-cylinder oxygen amount O2 from decreasing from the critical oxygen amount O2C. Further, the fuel control index k is set to be proportional to the accelerator pedal operation amount AP. Consequently, the control mode smoothly shifts (with no torque shock) to the idle mode 0 while preventing unstable combustion.

The demand torque index i is controlled so that the intake oxygen amount (the in-cylinder oxygen amount O2) increases after the control mode shifts to the low load mode 1. Therefore, the dashed line LA3, which is indicative of the corresponding fuel control index k calculated by the O2-based control, is a curve which is obtained by moving the solid line LA1 leftward. That is, when the control mode returns from the low load mode 1 to the normal mode 2, the pedal-based control shifts to the O2-based control indicated by the dashed line LA3 instead of the solid line LA1.

After the transition to the low load mode 1, if the accelerator pedal operation amount AP begins to increase before reaching "0", the control mode does not shift to the normal mode 2 at the point Pa. The control mode shifts to the normal mode 2 at the point Pa' where the following conditions are satisfied: i) the fuel control index kPDL calculated by the pedal-based control is greater than the fuel control index kO2 calculated by the O2-based control; ii) the fuel control index kPDL is greater than the critical fuel control index kC; and iii) the demand torque index i calculated to be proportional to the accelerator pedal operation amount AP is equal to or greater than the fixed value i0 in the low load mode 1. According to this transition control, the control mode can shift from the low load mode 1 to the normal mode 2 without torque shock. After the transition to the normal mode 2, the fuel control index k is calculated by the O2-based control as shown by the dashed line LA3. In the examples shown by the solid lines LB1, LB2, LC1, and LC2 and the dashed lines LB3 and LC3, the transition control is similarly performed. It is to be noted that inclinations of the solid lines LA2, LB2, and LC2 are set according to the engine rotational speed NE to obtain optimal characteristics.

Normally, the above-described three conditions i) to iii) are not simultaneously satisfied, but the condition iii) with respect to the demand torque index i is first satisfied and the fuel control index kPDL calculated by the pedal-based control finally reaches the fuel control index kO2 calculated by the O2-based control (the condition ii) is next satisfied and the condition i) is finally satisfied). Accordingly, the transition condition from the low load mode 1 to the normal mode 2 is satisfied when the fuel control index kPDL reaches the fuel control index kO2. Therefore, the fuel injection parameter Q* does not abruptly change, thereby preventing torque shock from occurring.

Further, if the accelerator pedal operation amount AP increases after the accelerator pedal operation amount AP reaches "0" in the low load mode 1 (i.e., if the accelerator pedal operation amount AP increases in the low load-to-deceleration rich transition mode 17, the deceleration rich-to-low load transition mode 16, or the idle mode 0), the demand torque index i is set to a fixed value i1 which is determined according to the engine rotational speed NE. When the pedal-based i value determined according to the accelerator pedal operation amount AP reaches the fixed value i1 (FIG. 17, point PT), the setting method of the demand torque index i is switched to the normal setting method by the pedal-based control. Further, the fuel control index k is calculated by the pedal-based control as shown by the solid line LS1 from the coordinate point 0 of FIG. 18. When the fuel control index k reaches the point PS, the control mode shifts to the normal mode 2. After the demand torque index i is set to a value, which is substantially proportional to the accelerator pedal operation amount AP, the calculation method of the fuel control index k is switched to the method by the O2-based control, and the control mode shifts to the normal mode 2. Therefore, torque shock does not occur in this case either.

Next, the high load mode 25 is more specifically described below. The objective of this control mode is to make the in-cylinder oxygen amount O2 promptly increase according to the driver's demand when the accelerator pedal is depressed a great amount. In this mode, the throttle valve 7 is substantially in the fully-opened condition, and the EGR control valve 14*b* is in the fully-closed condition. Therefore, the increase of the in-cylinder oxygen amount O2 is performed by increasing the target vane opening VOR (vane opening VO) and the fuel injection amount QINJ (hereinafter referred to as "bootstrap control"). By increasing the fuel injection amount QINJ in addition to the increase of the vane opening VO, the heat quantity supplied to the turbine increases, thereby boosting the increasing effect of the oxygen supply amount caused by increasing the vane opening VO.

The target vane opening VOR is determined by the PID control so that the in-cylinder oxygen amount O2 coincides with the target in-cylinder oxygen amount O2T25. The air handling parameter A* is basically determined according to the demand torque index i and the rotational speed index j like the normal mode 2. The target vane opening VOR, which is included in the air handling parameter A*, is changed to the value calculated by the PID control.

Further, the fuel injection parameter Q* is basically calculated according to the fuel control index k and the rotational speed index j like the normal mode 2. The fuel control index k is modified so that the fuel injection amount QINJ increases by a predetermined increase ratio RQAD (e.g., 10%) (in other words, the fuel control index k is changed to a fuel control index k' corresponding to the fuel injection parameter Q* in which the fuel injection amount QINJ is greater by the predetermined increase ratio RQAD). By setting the predetermined increase ratio RQAD to about 10%, good drivability (increasing characteristic of the engine rotational speed NE in accordance with the acceleration demand of the driver) is obtained while suppressing an amount of soot generated upon acceleration. It is desirable to choose the optimal value of the predetermined increase ratio RQAD so that the generated amount of soot becomes equal to or less than a predetermined limit value QSTLMT by experimenting with the engine and the vehicle that is to be controlled. The predetermined limit value QSTLMT is determined taking the capacity of the DPF 16, the regulation value of the soot emission amount, and the like, into consideration.

According to the bootstrap control, the fuel injection amount QINJ is increased to be a little more than the amount suitable for the in-cylinder oxygen amount O2. The increase in the fuel injection amount QINJ and the vane opening VO increases the in-cylinder oxygen amount O2. At the next fuel injection timing, the fuel injection amount QINJ is further increased which causes further increase in the in-cylinder oxygen amount O2. Accordingly, the in-cylinder oxygen amount O2 is increased stepwise and promptly with a slight increase in the injecting fuel, thereby obtaining good accelerating performance while suppressing the generated amount of soot.

FIGS. 19A-19E and 20A-20B are time charts, respectively, showing changes in the engine operating parameters and changes in the demand torque index i and the fuel control index k when the accelerator pedal operation amount AP rapidly decreases to "0" in the high load mode 25.

In a state where the control mode is the high load mode 25, the accelerator pedal is returned at time t1 and the control mode shifts to the normal mode 2. Since the bootstrap control ends at time t1, the fuel control index k decreases to a level in the normal mode 2. At time t2 immediately after time t1 (after about 0.1 seconds), the control mode shifts to the normal-to-low load transition mode 21. In the normal-to-low load transition mode 21, the demand torque index i is set to gradually decrease, and the intake air flow rate GA and the in-cylinder oxygen amount O2 decrease as the demand torque index i decreases. At time t3, the in-cylinder oxygen amount O2 reaches the critical oxygen amount O2C, and the control mode shifts to the low load mode 1. In the low load mode 1, the demand torque index i is controlled to be maintained at a constant value, the fuel control index k is controlled to gradually decrease, and the in-cylinder oxygen amount O2 is maintained substantially at the critical oxygen amount O2C. The intake pressure PI begins to decrease from the latter half of the normal-to-low load transition mode 21 and rapidly decreases in the vicinity of time t3. At time t4, the control mode shifts to the idle mode 0. The time period from time t1 to time t4 is about 1.2 seconds. Thus, the in-cylinder oxygen amount O2 is controlled to rapidly decrease in the normal-to-low load transition mode 21. Therefore, the engine rotational speed NE gradually decreases from the middle of the normal-to-low load transition mode 21, thereby preventing the engine rotational speed NE from unnecessarily rising.

FIGS. 21A-21E and 22A-22B are time charts, respectively, showing changes in the engine operating parameters and changes in the demand torque index i and the fuel control index k when a return operation of the accelerator pedal is started in the normal mode 2. The shown example corresponds to an operation example where the accelerator pedal operation amount AP gradually decreases in the normal mode 2, the control mode shifts to the low load mode 1 at time t31, and the control mode shifts from the low load mode 1 to the idle mode 0 at time t32.

In the normal mode 2, the demand torque index i decreases corresponding to a reduction in the accelerator pedal operation amount AP, and the intake air flow rate GA and the in-cylinder oxygen amount O2 decrease. The fuel control index k decreases corresponding to the reduction of the oxygen in-cylinder amount O2. When the in-cylinder oxygen amount O2 decreases to the critical oxygen amount O2C (time t31), the control mode shifts to the low load mode 1. The demand torque index i is maintained at a fixed value in the low load mode 1. This makes the in-cylinder oxygen amount O2 gradually increase. The fuel control index k decreases corresponding to the reduction in the accelerator pedal operation amount AP. When the fuel control index k reaches the minimum value kMIN after the accelerator pedal operation amount AP reaches "0", the control mode shifts to the idle mode 0 (time t32).

In the shown example, the engine rotational speed NE gradually changes corresponding to a change in the speed VP of the vehicle driven by the engine 3 (vehicle speed) since the engaged state of the clutch is maintained. No large change in the engine rotational speed NE occurs upon the transition of the control mode, thereby attaining smooth control without torque shock.

FIGS. 23A-23E and 24A-24B are time charts, respectively, showing changes in the engine operating parameters and changes in the demand torque index i and the fuel control index k when the accelerator pedal operation amount AP gradually increases from the idle mode 0. The shown example corresponds to an operation example where the accelerator pedal is started to be depressed at time t41, the control mode shifts to the low load mode 1, the accelerator pedal operation amount AP gradually increases, and the control mode shifts to the normal mode 2 at time t42.

In the low load mode 1, the demand torque index i is initially maintained at the fixed value i1. When the i value (iPDL) calculated according to the accelerator pedal operation amount AP exceeds the fixed value i1 (time t41*a*), the demand torque index i is set to the pedal-based value iPDL and increases with the increase in the accelerator pedal operation amount AP. The fuel control index k increases (proportionally) with the increase in the accelerator pedal operation amount AP. At time t42, a "k" value calculated according to the accelerator pedal operation amount AP coincides with a "k" value calculated according to the in-cylinder oxygen amount O2, and the control mode shifts from the low load mode 1 to the normal mode 2. After the transition to the normal mode 2, the fuel control index k is set to a value according to the in-cylinder oxygen amount O2.

By implementing the control method described above, the in-cylinder oxygen amount O2 always becomes greater than the critical oxygen amount O2C, thereby securing stabilized combustion. Also in the shown example, the engine rotational speed NE gradually changes corresponding to the change in the vehicle speed VP, since the engaged state of the clutch is maintained. No large change in the engine rotational speed NE occurs upon the transition of the control mode, thereby attaining smooth control without torque shock.

FIGS. 25A-25D and 26A-26D show changes in the engine operating parameters and the vehicle speed VP upon rapid acceleration. FIGS. 25A-25D correspond to an example where the bootstrap control is performed, and FIGS. 26A-26D correspond to an example where the bootstrap control is not performed. Further, FIGS. 27A-27B show changes in the demand torque index i and the fuel control index k when performing the bootstrap control.

Figure 27A:
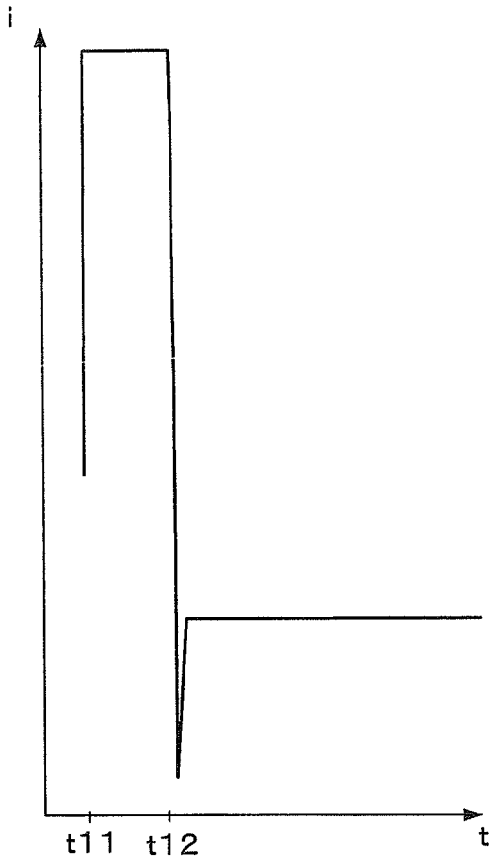
FIGS. 27A-27B are time charts illustrating changes in the control parameters (i, k) when performing the bootstrap control upon acceleration.
Figure 27B:
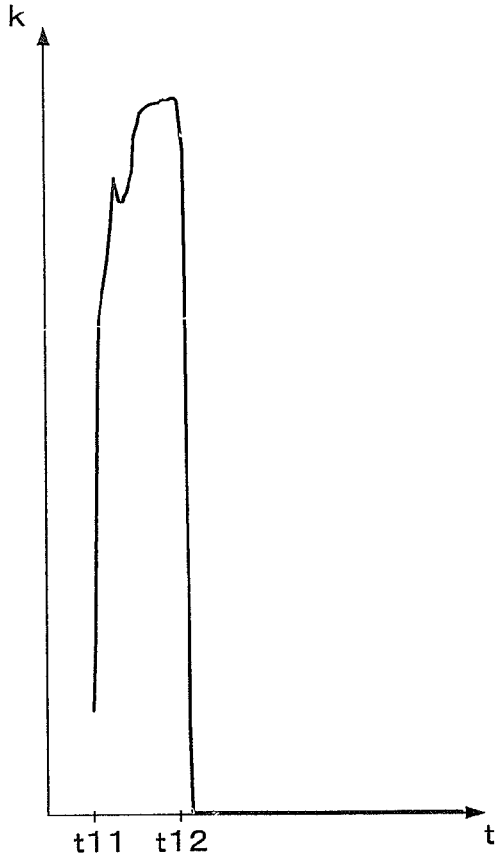

In the example where the bootstrap control is performed, the control mode shifts to the high load mode 25 when the accelerator pedal is depressed at time t11, as shown in FIGS. 25A-25D, and the demand torque index i rapidly increases as shown in FIGS. 27A-27B. The above-described opening control of the vane opening VO is performed, and the fuel control index k is changed to a value which is a little greater than the value corresponding to the in-cylinder oxygen amount O2. Therefore, the intake pressure PI and the intake air flow rate GA rapidly increase, and the in-cylinder oxygen amount O2 rapidly increases. Consequently, the vehicle speed VP promptly rises to obtain good accelerating performance. If the accelerator pedal is returned at time t12, the control mode shifts to the normal mode 2, and the intake pressure PI, the intake air flow rate GA, and the in-cylinder oxygen amount O2 rapidly decrease, and the vehicle speed VP gradually decreases. The time period from time t11 to t12 is about 10 seconds, and the vehicle speed VP increases from 55 km/h to 110 km/h.

On the other hand, in the example shown in FIGS. 26A-26D, when the accelerator pedal is depressed at time t21, the intake pressure PI and the intake air flow rate GA gradually increase. At time t22, each of the intake pressure PI, the intake air flow rate GA, and the in-cylinder oxygen amount O2 reaches the maximum value. However, the maximum level of each parameter is about 65% of the maximum value obtained when performing the bootstrap control. Therefore, the vehicle speed VP gradually rises. The time period from time t21 to t22 is about 33 seconds, and the vehicle speed VP increases from 60 km/h to 110 km/h. That is, the accelerating performance is very low when the bootstrap control is not performed.

In this embodiment, the throttle valve 7 and the supercharging device 9 correspond to an intake air amount control means, the air flow sensor 27 corresponds to an intake air amount detecting means, the crank angle sensor 22 corresponds to a rotational speed detecting means, the accelerator sensor 30 corresponds to a demand torque parameter detecting means, and the intake air temperature sensor 25 corresponds to an intake air temperature detecting means. The ECU 2 constitutes an air handling parameter calculating means, a recirculated exhaust amount calculating means, an in-cylinder oxygen amount calculating means, a compression end temperature calculating means, a fuel injection parameter determining means, an oxygen concentration calculating means, a fuel injection timing correcting means, a fuel correcting means, a determining means, a boost pressure control means, and an injector control means.

Further, in the embodiment described above, the condition that the demand torque index iPDL, which in this case depends on the accelerator pedal operation amount AP, exceeds the fixed value i1, is used as a transition condition from the low load mode 1 to the normal mode 2. Alternatively, a condition that the accelerator pedal operation amount AP exceeds a determination threshold value APTH, may be used as the transition condition. In this case, the determination threshold value APTH is set according to the engine rotational speed NE, since the accelerator pedal operation amount corresponding to the fixed value i1 changes according to the engine rotational speed NE.

Further, in the above-described embodiment, the condition that the demand torque index i is greater than the zero EGR threshold value iEGR0 and the fuel control index k is less than the steady state reference value kS is used as a transition condition from the normal mode 2 to the high load mode 25. Alternatively, a condition that the accelerator pedal operation amount AP exceeds a high load determination threshold value APHLTH, may be used. The high load determination threshold value APHLTH is the accelerator pedal operation amount corresponding to the zero EGR threshold value iEGR0.

Further, in the above-described embodiment, the turbocharger is used as the supercharging device. Alternatively, a mechanically-driven supercharger may be used for the supercharging device.

The present invention can also be applied to a control system for a watercraft propulsion engine, such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A control system for an internal combustion engine having an intake system for supplying an amount of air to at least one cylinder, at least one fuel injector for injecting fuel into said at least one cylinder, and an exhaust gas recirculation device for recirculating a portion of an exhaust gas to said intake system, said control system comprising:

an air flow sensor that detects an intake air amount;

a crank angle sensor that detects a rotational speed of said engine; and an electronic control unit (ECU) programmed to:

calculate an amount of the exhaust gas recirculated by said exhaust gas recirculation device;

calculate an in-cylinder oxygen amount correlated parameter which is correlated with an amount of oxygen existing in the at least one cylinder before fuel injection by said at least one fuel injector based on an oxygen amount contained in the detected intake air amount and an oxygen amount contained in the calculated amount of the recirculated exhaust gas;

determine a fuel injection parameter by retrieving a fuel injection parameter map according to the in-cylinder oxygen amount correlated parameter and the engine rotational speed;

correct a fuel injection timing, which is contained in the fuel injection parameter, so that a retard amount of the fuel injection timing increases as the in-cylinder oxygen amount correlated parameter correlated with an amount of oxygen existing in the at least one cylinder before fuel injection by said at least one fuel injector increases; and control said at least one fuel injector based on the corrected fuel injection parameter.

2. The control system according to claim 1, wherein the ECU is further programmed to:

correct a fuel injection amount contained in the fuel injection parameter in an increasing direction when said engine is in a predetermined high load operating condition, and control said at least one fuel injector based on the corrected fuel injection parameter.

3. The control system according to claim 2, wherein said ECU is further programmed to determine the fuel injection parameter according to the rotational speed of said engine and a parameter indicative of a demand torque of said engine when said engine is in a predetermined low load operating condition.

4. The control system according to claim 3, wherein said engine has a supercharging device for pressurizing an intake pressure, and said control system further includes boost pressure control means for controlling the supercharging device to increase a boost pressure when said engine is in the predetermined high load operating condition.

5. The control system according to claim 4, further comprising:

intake air temperature detecting means for detecting an intake air temperature of said engine; and wherein said ECU is further programmed to calculate a compression end temperature according to the intake air temperature, the compression end temperature being a temperature in the at least one cylinder when a piston in the at least one cylinder is located in a vicinity of top dead center and an air-fuel mixture in the at least one cylinder is compressed, and retrieve the fuel injection parameter map according to the compression end temperature.

6. The control system according to claim 4, wherein the in-cylinder oxygen amount correlated parameter comprises an amount of oxygen existing in the at least one cylinder and an oxygen concentration which is obtained by dividing the in-cylinder oxygen amount by a sum of the detected intake air amount and the calculated amount of the recirculated exhaust gas, wherein said ECU is further configured to use the in-cylinder oxygen amount when determining the fuel injection amount, and use the oxygen concentration when correcting the fuel injection timing.

7. The control system according to claim 2, wherein said engine has a supercharging device for pressurizing an intake pressure, and said control system further includes boost pressure control means for controlling the supercharging device to increase a boost pressure when said engine is in the predetermined high load operating condition.

8. The control system according to claim 7, further comprising:

intake air temperature detecting means for detecting an intake air temperature of said engine; wherein said ECU is further programmed to calculate a compression end temperature according to the intake air temperature, the compression end temperature being a temperature in the at least one cylinder when a piston in the at least one cylinder is located in a vicinity of top dead center and an air-fuel mixture in the at least one cylinder is compressed, and retrieve the fuel injection parameter map according to the compression end temperature.

9. The control system according to claim 7, wherein the in-cylinder oxygen amount correlated parameter comprises an amount of oxygen existing in the at least one cylinder and an oxygen concentration which is obtained by dividing the in-cylinder oxygen amount by a sum of the detected intake air amount and the calculated amount of the recirculated exhaust gas, wherein said ECU is further programmed to use the in-cylinder oxygen amount when determining the fuel injection amount, and use the oxygen concentration when correcting the fuel injection timing.

10. The control system according to claim 2, wherein said ECU is further programmed to set a degree of increasing the fuel injection amount so that an amount of soot emitted from said engine becomes equal to or less than a predetermined limit value.

11. The control system according to claim 1, wherein said ECU is further programmed to determine the fuel injection parameter according to the rotational speed of said engine and a parameter indicative of a demand torque of said engine when said engine is in a predetermined low load operating condition.

12. The control system according to claim 11, wherein said engine has a supercharging device for pressurizing an intake pressure, and said control system further includes boost pressure control means for controlling the supercharging device to increase a boost pressure when said engine is in a predetermined high load operating condition.

13. The control system according to claim 12, further comprising:

intake air temperature detecting means for detecting an intake air temperature of said engine; and wherein said ECU is further programmed to calculate a compression end temperature according to the intake air temperature, the compression end temperature being a temperature in the at least one cylinder when a piston in the at least one cylinder is located in a vicinity of top dead center and an air-fuel mixture in the at least one cylinder is compressed, and retrieve the fuel injection parameter map according to the compression end temperature.

14. The control system according to claim 12, wherein the in-cylinder oxygen amount correlated parameter comprises an amount of oxygen existing in the at least one cylinder and an oxygen concentration which is obtained by dividing the in-cylinder oxygen amount by a sum of the detected intake air amount and the calculated amount of the recirculated exhaust gas, wherein said ECU is programmed to use the in-cylinder oxygen amount when determining a fuel injection amount, and use the oxygen concentration when correcting the fuel injection timing.

15. The control system according to claim 1, wherein said engine has a supercharging device for pressurizing an intake pressure, and said control system further includes boost pressure control means for controlling the supercharging device to increase a boost pressure when said engine is in a predetermined high load operating condition.

16. The control system according to claim 15, further comprising:

intake air temperature detecting means for detecting an intake air temperature of said engine; and wherein the ECU is further programmed to calculate a compression end temperature according to the intake air temperature, the compression end temperature being a temperature in the at least one cylinder when a piston in the at least one cylinder is located in a vicinity of top dead center and an air-fuel mixture in the at least one cylinder is compressed, and retrieve the fuel injection parameter map according to the compression end temperature.

17. The control system according to claim 15, wherein the in-cylinder oxygen amount correlated parameter comprises an amount of oxygen existing in the at least one cylinder and an oxygen concentration which is obtained by dividing the in-cylinder oxygen amount by a sum of the detected intake air amount and the calculated amount of the recirculated exhaust gas, wherein said ECU is programmed to use the in-cylinder oxygen amount when determining a fuel injection amount, and said injection timing correction means uses the oxygen concentration when correcting the fuel injection timing.

18. The control system according to claim 1, further comprising:

intake air temperature detecting means for detecting an intake air temperature of said engine, wherein said ECU is further programmed to calculate a compression end temperature according to the intake air temperature, the compression end temperature being a temperature in the at least one cylinder when a piston in the at least one cylinder is located in a vicinity of top dead center and an air-fuel mixture in the at least one cylinder is compressed, and retrieve the fuel injection parameter map according to the compression end temperature.

19. The control system according to claim 1, wherein the in-cylinder oxygen amount correlated parameter comprises an amount of oxygen existing in the at least one cylinder and an oxygen concentration which is obtained by dividing the in-cylinder oxygen amount by a sum of the detected intake air amount and the calculated amount of the recirculated exhaust gas, wherein said ECU is programmed to use the in-cylinder oxygen amount when determining a fuel injection amount, and use the oxygen concentration when correcting the fuel injection timing.

* * * * *